US005472521A

United States Patent [19]

Yoshitomi et al.

[11] Patent Number: 5,472,521

[45] Date of Patent: Dec. 5, 1995

[54] PRODUCTION METHOD OF GRAIN ORIENTED ELECTRICAL STEEL SHEET HAVING EXCELLENT MAGNETIC CHARACTERISTICS

[75] Inventors: Yasunari Yoshitomi; Maremizu Ishibashi; Yoichi Mishima; Koji Yamasaki, all of Kitakyushu, all of Japan

[73] Assignee: Nippon Steel Corporation, Tokyo, Japan

[21] Appl. No.: 322,909

[22] Filed: Oct. 13, 1994

[30] Foreign Application Priority Data

| | | | |
|---|---|---|---|
| Oct. 19, 1933 | [JP] | Japan | 5-261343 |
| Oct. 19, 1993 | [JP] | Japan | 5-261344 |
| Oct. 25, 1993 | [JP] | Japan | 5-266575 |
| Nov. 10, 1993 | [JP] | Japan | 5-281181 |

[51] Int. Cl.[6] ..... H01F 1/147

[52] U.S. Cl. ..... 148/111; 148/112

[58] Field of Search ..... 148/111, 112

[56] References Cited

U.S. PATENT DOCUMENTS

| | | | |
|---|---|---|---|
| 3,287,183 | 11/1966 | Taguchi et al. | 148/111 |
| 3,932,234 | 1/1976 | Imanaka et al. | 148/112 |
| 4,929,286 | 5/1990 | Komatsu et al. | 148/111 |

FOREIGN PATENT DOCUMENTS

| | | |
|---|---|---|
| 378131 | 7/1990 | European Pat. Off. . |
| 391335 | 10/1990 | European Pat. Off. . |
| 390140 | 10/1990 | European Pat. Off. . |
| 420238 | 4/1991 | European Pat. Off. . |
| 534432 | 3/1993 | European Pat. Off. . |
| 40-15644 | 7/1965 | Japan . |
| 51-13469 | 4/1976 | Japan . |
| 52-24116 | 2/1977 | Japan . |
| 54-24685 | 8/1979 | Japan . |
| 57-89433 | 6/1982 | Japan . |
| 57-158322 | 9/1982 | Japan . |
| 59-56522 | 4/1984 | Japan . |
| 59-190324 | 10/1984 | Japan . |
| 2-182866 | 7/1990 | Japan . |
| 2-263924 | 10/1990 | Japan . |
| 2-263923 | 10/1990 | Japan . |
| 2-274812 | 11/1990 | Japan . |
| 2-274815 | 11/1990 | Japan . |
| 2-274811 | 11/1990 | Japan . |
| 3-294427 | 12/1991 | Japan . |

(List continued on next page.)

OTHER PUBLICATIONS

Patent Abstracts of Japan, vol. 1, No. 61 (C–77) 15 Jun. 1977 & JP–A–52 024 116 (Shin Nippon Seitetsu) 23 Feb. 1977 abstract.

Patent Abstracts of Japan, vol. 6, No. 174 (C–123) (1052) 8 Sep. 1982 & JP–A–57 089 433 (Kawasaki Seitetsu) 3 Jun. 1982 abstract.

Patent Abstracts of Japan, vol. 9, No. 45 (C–268) (1768) 25 Feb. 1985 & JP–A–59 190 324 (Kawasaki Seitetsu) 29 Oct. 1984 abstract.

*Primary Examiner*—John Sheehan

*Attorney, Agent, or Firm*—Kenyon & Kenyon

[57] ABSTRACT

This invention is directed to improve magnetic properties and to stabilize the magnetic properties of a grain oriented electrical steel sheet used as a core of electric appliances. When producing a grain oriented electrical steel sheet by heating a slab containing C, Si, acid-soluble Al, N, not more than 0.014% of S+0.405 Se and 0.05 to 0.8% of Mn and the balance consisting of Fe and unavoidable impurities at a temperature of less than 1,280° C., effecting hot rolling, applying cold rolling, decarbonization annealing and final finish annealing without annealing hot rolled sheet, the production method of the present invention controls the precipitation quantity of AlN in the hot rolled sheet, controls the mean grain size of the primary crystallization grains from completion of decarbonization annealing to the start of final finish annealing, applies nitriding treatment after hot rolling but before the start of secondary recrystallization at final finish annealing, controls the hot rolling condition in accordance with the quantities of acid-soluble Al and N of the slab, and further adds Sn.

7 Claims, 5 Drawing Sheets

N,Nas Al/N: VALUES IN HOT ROLLED SHEET

OTHER PUBLICATIONS

| | | | |
|---|---|---|---|
| 5-125445 | 5/1993 | Japan | 148/111 |
| 5-230534 | 9/1993 | Japan | 148/111 |
| 5-295443 | 11/1993 | Japan | 148/111 |
| 6-17129 | 1/1994 | Japan | 148/111 |
| 6-49543 | 2/1994 | Japan | 148/111 |
| 6-49542 | 2/1994 | Japan | 148/111 |
| 2095287 | 9/1982 | United Kingdom . | |
| 2130241 | 5/1984 | United Kingdom . | |

N,Nas AℓN: VALUES IN HOT ROLLED SHEET

FoT: START TEMPERATURE OF FINISH HOT ROLLING

FoT: START TEMPERATURE OF FINISH HOT ROLLING

ST(°C): SLAB HEATING TEMPERATURE

FoT: START TEMPERATURE OF FINISH HOT ROLLING

ΔFoT: DEVIATION OF INSIDE COIL OF STARTING TEMPERATURE OF FINISH HOT ROLLING

PRODUCTION METHOD OF GRAIN ORIENTED ELECTRICAL STEEL SHEET HAVING EXCELLENT MAGNETIC CHARACTERISTICS

BACKGROUND OF THE INVENTION

1. Field of the Invention

This invention relates to a production method for a grain oriented electrical steel sheet, having excellent magnetic properties which can be used as the core of transformer, etc.

2. Description of the Related Art

Grain-oriented electrical steel sheet has been primarily used as the core material for transformers and other electrical appliances, and must have excellent magnetic properties such as excitation characteristics, iron loss, and so forth. A flux density $B_8$ at a magnetic field intensity of 800 A/m is generally used as a numerical value representing the excitation characteristics. The iron loss $W_{17/50}$ per kg when the steel sheet is magnetized to 1.7 Tesla (T) at a frequency of 50 Hz is used as a numerical value representing the iron loss. The magnetic flux density has the largest influence on the iron loss. Generally speaking, the higher the magnetic flux density, the better the iron loss. Generally, when the magnetic flux density is increased, the secondary recrystallization grain tends to be coarse, resulting in the inferior iron loss in some case. To cope with this problem, the iron loss can be improved by magnetic domain control irrespective of the size of the secondary recrystallization grains.

This known grain oriented electrical steel sheet is produced by causing secondary recrystallization in a final finish annealing step and developing a so-called "goss texture" having a {110} axis in the direction parallel to the steel sheet surface and a <001> axis in the rolling direction. To obtain particularly excellent magnetic properties, <001> as an easy axis of magnetization must be aligned highly accurately with the rolling direction.

The production technology for such a grain oriented electrical sheet with a high magnetization flux density is typically disclosed in Japanese Examined Patent Publication (Kokoku) Nos. 40-15644 and 51-13469. The former uses MnS and AlN as the main inhibitors while the latter uses MnS, MnSe, Sb, etc. In accordance with the present state of the art, therefore, the sizes and shapes of the precipitates functioning as these inhibitors and their dispersion state must be appropriately controlled. As to MnS, a method is employed at present which produces a complete solid solution of MnS at the time of heating a slab before hot rolling, and allows it to precipitate at the time of hot rolling. To produce a complete solid solution of MnS, in an amount necessary for secondary recrystallization, a temperature of about 1,400° C. is necessary.

This temperature is at least about 200° C. higher than the slab heating temperature for an ordinary steel, and this high-temperature slab heat-treatment involves the following disadvantages:

1) a high temperature slab heating furnace for exclusive use with grain-oriented electrical steel is necessary;
2) the energy raw unit of the heating furnace is high; and
3) the quantity of the molten scale increases and adversely influences operations such as the scrape-out of slag.

These problems can be avoided by reducing the slab heating temperature to the heating temperature of ordinary steel. However, this means a reduction in the quantity of MnS effective as an inhibitor or non-using of MnS, and essentially invites destabilization of the secondary recrystallization. Accordingly, in order to accomplish slab heating at low temperature, the inhibitors must be reinforced, in one way or other, by precipitates other than MnS and the normal grain growth during finish annealing must be sufficiently restricted.

In addition to the sulfides, nitrides, oxides and grain boundary segreation elements are known as such inhibitors, and the following references are known. Japanese Examined Patent Publication (Kokoku) No. 54-24685 causes grain boundary segregation elements such as As, Bi, Sn, Sb, etc., to be contained in the steel so as to lower the slab heating temperature to the range of 1,050° to 1,350° C., and Japanese Unexamined Patent Publication (Kokai) No. 52-24116 discloses a method which lowers the slab heating temperature to the range of 1,100° to 1,260° C. by causing nitride formation elements such as Zr, Ti, B, Nb, Ta, V, Cr, Mo, etc., besides Al, to be contained. Japanese Unexamined Patent Publication (Kokai) No. 57-158322 discloses a technology which carries out slab heating at low temperature by reducing the Mn content and lowering the Mn/S ratio to below 2.5, and stabilizes the secondary recrystallization by further adding Cu.

A technology which improves the structure in combination with reinforcement of these inhibitors has also been disclosed. In other words, Japanese Unexamined Patent Publication (Kokai) No. 57-89433 adds elements such as S, Se, Sb, Bi, Pb, Sn, B, etc., in addition to Mn, combines these elements with the ratio of columnar crystal in the slab and a secondary cold rolling ratio at the second cold-rolling stage so as to accomplish low temperature slab heating at 1,100° to 1,250° C. Further, Japanese Unexamined Patent Publication (Kokai) No. 59-190324 discloses a method which constitutes an inhibitor using Al, B and N as the primary elements in addition to S or Se, applies pulse annealing at the time of primary recrystallization annealing after cold rolling, and thus stabilizes secondary recrystallization.

As described above, great efforts have been made to accomplish slab heating at low temperature in the production of directional electromagnetic steel sheets. Further, Japanese Unexamined Patent Publication (Kokai) No. 59-56522 discloses a technology which can accomplish slab heating at low temperature by setting the amount of Mn to 0.08 to 0.45% and the amount of S to not greater than 0.007%. This method can solve the problem of the occurrence of linear secondary recrystallization defects of the product resulting from coarsening of the slab crystal grain during slab heating at high temperature.

Although the method of low-temperature slab heating is originally directed to reduce the cost of production, it cannot be put into industrial application unless it can stably produce excellent magnetic properties. To make low-temperature slab heating industrially applicable, the inventors of the present invention have developed a technique which is based on (1) control of the mean grain size of primary recrystallization before final finish annealing and (2) a nitriding treatment of the steel sheet at the intermediate stage from the completion of hot rolling to the start of secondary recrystallization at the final finish annealing. The nitride formed by this nitriding treatment mainly changes to AlN at the onset of secondary recrystallization. In other words, this method uses AlN as an inhibitor which hardly changes at a high temperature and in this sense, it is an essential condition that the slab contains On the other hand, the presence of an excessive amount of N in the slab must be reconsidered from the component system of this technology. In other words, if essential AS and a certain amount of N are contained in the slab, AlN is formed during the process steps from slab heating to decarbonization annealing, and the AlN affects the grain growth of the primary recrystallization grain at the time of decarbonization annealing.

As a result of investigations into means for controlling the precipitation of AlN in the process steps described above, it is an object of the present invention to provide a production method for a grain oriented electrical steel sheet having excellent properties, which is free of magnetic fluctuation even when hot rolling annealing is omitted, with slab heating at low temperature.

SUMMARY OF THE INVENTION

The grain oriented electrical sheet to which the present invention is directed can be produced by casting a molten steel, obtained by a conventional steel making method, by using a continuous casting method or an ingotting method, forming a slab by interposing a slabbing step whenever necessary, subsequently hot rolling the slab to a hot rolled sheet, applying final cold rolling to the hot rolled sheet, without annealing it, by a reduction ratio of at least 80%, and sequentially carrying out decarbonization annealing and final finish annealing.

The inventors of the present invention have conducted intensive studies on the causes of fluctuation of the magnetic properties and a solution method therefor when a low temperature slab heated material is produced by a single cold rolling method eliminating annealing of hot rolled sheet. As a result, the present inventors have clarified that the fluctuation of the magnetic properties can be reduced by controlling the amount of precipitated AlN in the hot rolled sheet.

Furthermore, the present inventors have clarified that the following means are extremely effective for reducing the fluctuation in the magnetic properties:

(1) control of the reduction ratio in rough hot rolling and the time between rough hot rolling and finish hot rolling;

(2) control of start temperature of finish hot rolling in accordance with the quantities of acid-soluble Al and N in the slab;

(3) control of the slab heating temperature, in accordance with the quantities of acid-soluble Al and N of the slab, in combination with control of start temperature of the finish hot rolling;

(4) control of deviation inside the coil of start temperatures of the finish hot rolling in accordance with the quantities of acid-soluble Al and N in the slab; and (5) addition of Sn.

The present invention is connected with the technology disclosed by the present inventors in Japanese Unexamined Patent Publication (Kokai) No. 2-182866 and is based on the concept that the crystal structure after decarbonization annealing is made appropriate. Further, the present invention is based on the premise that annealing is not applied to the hot rolled sheet, and it is believed that N, in solution at the time of completion of heating of the slab, precipitates as fine nitrides (primarily, AlN) during hot rolling or at the time of decarbonization annealing (particularly at the time when the temperature is elevated).

It is further believed that the sizes and precipitation quantities of such very small nitrides are affected even by a slight change in temperature at the time of decarbonization annealing. However, the grain growth inhibition effect due to the precipitates (Zener factors) is inversely proportional to the sizes of the precipitates and is proportional to the volume fraction. Accordingly, the effect of grain growth inhibition by the precipitates will become too small if the quantity of N in solution is excessively small at completion of slab heating, so that the grain growth becomes excessive at the time of decarbonization annealing and control of the structure becomes difficult.

The present invention provides a method which solves the problem of the fluctuation in the magnetic properties resulting from AlN by controlling the hot rolling conditions in conjunction with the slab components so that the quantity of AlN precipitation in the hot rolled sheet falls within a predetermined range.

In other words, in a method for producing a grain oriented electrical steel sheet by heating a slab containing up to 0.075% of C, 2.2 to 4.5% of Si, 0.010 to 0.060% of acid-soluble Al, up to 0.0130% of N, up to 0.014% of S+0.405 Se, 0.05 to 0.8% of Mn in terms of a weight ratio, and the balance consisting of Fe and unavoidable impurities, at a temperature of less than 1,280° C.; conducting hot rolling; subsequently conducting final high reduction cold rolling without applying annealing to the hot rolled sheet; and conducting decarbonization annealing and final finish annealing; the method of the present invention is characterized in that the N quantity (weight ratio) as AlN in the hot rolled sheet is so set as to satisfy N-N as AlN$\leqq$0.0030% and (N as AlN)/N$\geqq$0.55 with the N quantity precipitated as AlN in the hot rolled sheet being N as AlN, the mean grain size of the primary recrystallized grains from completion of decarbonization annealing until the start of final finish annealing is 18 to 35 μm, and nitriding treatment is carried out so as to let the steel sheet absorb at least 0.0010 wt % of nitrogen from hot rolling until the start of secondary recrystallization at finial finish annealing stage.

DESCRIPTION OF THE PREFERRED EMBODIMENTS

Figure 1:
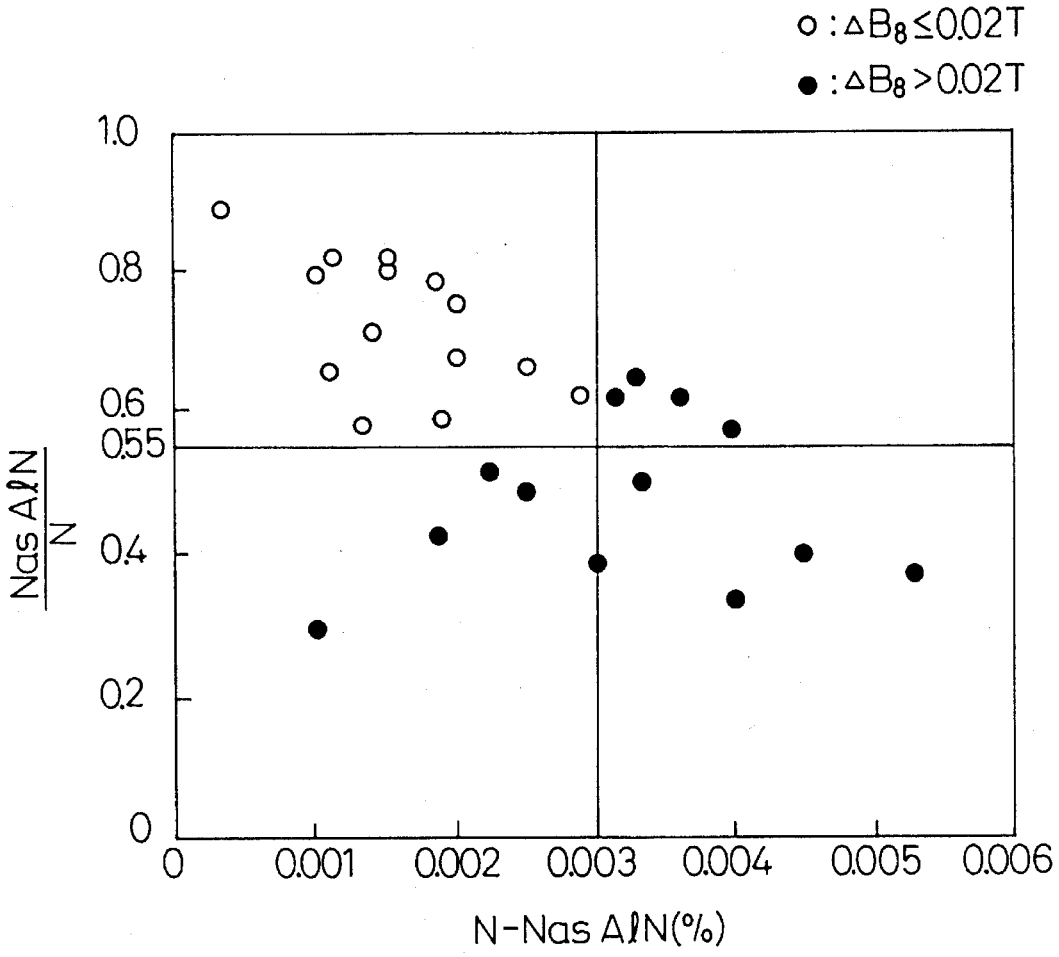
FIG. 1 is a graph showing the relationship between the precipitation quantity of AlN is a hot rolled sheet and the fluctuation of a magnetic flux density in the product.

First, the effects of the present invention will be explained. The relationship between an AlN precipitation quantity of a hot rolled sheet and a magnetic flux density of a product will be first described on the basis of the following experiments.

A slab comprising 0.025 to 0.051% of C, 2.6 to 3.1% of Si, 0.021 to 0.041% of acid-soluble Al, 0.0018 to 0.0095% of N, 0.005 to 0.007% of S, 0.09 to 0.17% of Mn, in terms of a weight ratio, and the balance consisting of Fe and unavoidable impurities, and having a thickness of 250 mm was produced. After the slab was held at a temperature of 1,000° to 1,250° C. for about 90 minutes, rough hot-rolling was carried out in seven passes to a thickness of 40 mm. Next, finish hot-rolling was carried out in six passes, and a 2.3 mm-thick hot-rolled sheet was obtained.

High reduction rolling was carried out, at a reduction ratio of about 85%, without applying hot-rolled sheet annealing to the hot-rolled sheet, and a cold rolled sheet having a final thickness of 0.335 mm was obtained. Decarbonization annealing was carried out on this cold rolled sheet under the following four conditions:

(1) 810° C., soaking time: 150 seconds (2) 820° C., soaking time: 150 seconds (3) 830° C., soaking time: 150 seconds (4) 840° C., soaking time: 150 seconds.

Next, during annealing in which the rolled sheet was held at 750° C. for 30 seconds, an $NH_3$ gas was mixed with the annealing atmosphere to allow the steel sheet to absorb nitrogen.

The N quantity after this nitriding treatment was 0.0198 to 0.0253 wt %, and the mean grain size (mean value of the diameter of a circle) with the same area as the primary recrystallization grains was 19 to 28 μm. An annealing separating agent, consisting of MgO as the principal component, was coated onto the steel sheet after the nitriding treatment, and then a final finish annealing was carried out. Thereafter, the magnetic flux density of each product was measured and the differences $\Delta B_8$ between the maximum and minimum values of $B_8$ under the four decarbonization annealing conditions employed for the cold rolled sheets having the same components and under the same hot rolling conditions were determined. The quantity of N existing as AlN (weight ratio: N as AlN) in the hot rolled sheets of this experiment was determined by chemical analysis, and the quantities of N-N as AlN, (N as AlN)/N were calculated for each sample.

FIG. 1 shows the relationship between the AlN precipitation quantity for the hot-rolled sheet and the fluctuation of the flux density in the product. As can be clearly seen from this graph, $\Delta B_8$ was below 0.02, and stable magnetic characteristics could be obtained, when N-N as AlN$\leqq$0.0030% and (N as AlN)/N$\geqq$0.55 in the hot rolled sheet.

The mechanism of the effect of controlling the AlN precipitation quantity in the hot rolled sheet shown in FIG. 1 has not yet been sufficiently clarified, but the inventors of the present invention assume that the N which is in the solid solution state at the time of completion of heating of the slab precipitates as very small nitrides (mainly AlN) during hot rolling or decarbonization annealing (particularly at the time of the temperature rise), and the sizes and precipitation quantities of the very small nitrides are affected even by a slight temperature change during the decarbonization annealing.

However, the grain growth inhibition effect by the precipitates (Zener factors) is inversely proportional to the size of the precipitate and proportional to its volume fraction. Accordingly, when the quantity of N in solution is excessively small at completion of slab heating, the grain growth inhibition effect by the precipitate becomes excessively small, so that the grain growth in decarbonization annealing becomes excessive and control of the structure becomes difficult.

As described above, the precipitation control of AlN in the process steps described above is important, but its control, by regulation of process conditions, such as components, hot rolling, and so forth, is by no means easy. Particularly when the annealing of a hot-rolled sheet is omitted as in the present invention, a novel standard for AlN precipitation control becomes necessary. In connection with this point, the inventors of the present invention have acquired the new knowledge shown in FIG. 1 as a result of intensive experiments and analyses.

In other words, even when the annealing of a hot rolled sheet is omitted even in the case of low temperature slab heating, excellent magnetic properties can be stably obtained by controlling the proportion of the quantity of N as AlN to the N quantity in the hot rolled sheet. This indicates that there is a condition of AlN precipitation which easily provides the desitable structure during decarbonization annealing, and is believed to suggest that the precipitation condition of AlN can be checked in the hot rolled sheet.

The inventors of the present invention have investigated their knowledge shown in FIG. 1 in connection with the components and the process conditions.

In other words, the present inventors have examined the fluctuation in the flux density of a product in connection with the Al (%)−(27/14)×N (%) quantity (where Al is acid-soluble Al) and the finish hot rolling starting temperature T (°C.).

In this case, a slab comprising 0.024 to 0.035% of C, 2.5 to 3.2% of Si, 0.026 to 0.040% of acid-soluble Al, 0.0050 to 0.0078% of N, 0.005 to 0.007% of S, 0.10 to 0.14% of Mn in terms of a weight, the balance consisting of Fe and unavoidable impurities, and having a thickness of 250 mm, was produced.

After the slab was held at a temperature of 1,050° to 1,250° C. for about 90 minutes, rough hot rolling was carried out, in seven passes, to a thickness of 40 mm, and finish hot rolling was then carried out, in six passes, to obtain a hot rolled sheet having a thickness of 2.3 mm. In this hot rolling, the start temperature of finish hot rolling was set within a broad range by applying water cooling between the passes of rough hot rolling, changing the time interval between the passes and positively changing the time interval between the rough hot-rolling and finish hot rolling.

High reduction rolling was carried out on the hot rolled sheet at a reduction ratio of about 85% without annealing of hot rolled sheet, and a cold rolled sheet having a final sheet thickness of 0.335 mm was obtained. Decarbonization annealing was carried out on the cold rolled sheet under the four conditions, that is, (1) at 810° C., (2) at 820° C., (3) at 830° C. and (4) at 840° C., with a retention time of 150 seconds at each of these temperatures. Next, a $NH_3$ gas was mixed with the annealing atmosphere in which the decarbonized sheet was held at 750° C. for 30 seconds, so that the steel sheet was allowed to absorb nitrogen.

The N quantity after this nitriding treatment was 0.0194 to 0.0247 wt %, and the mean grain size (mean value of a diameter of the circle with the same as the grain has) was 20 to 28 μm. An annealing separating agent, consisting of MgO as the principal component, was applied to the steel sheet after the nitriding treatment, and final finish annealing was carried out. Thereafter, the flux density of the product was measured, and differences $\Delta B_8$ between the maximum and minimum values of $B_8$, under the four decarbonization annealing conditions used for the cold rolled sheets having the same components and under the same hot rolling conditions, were determined.

Figure 2:
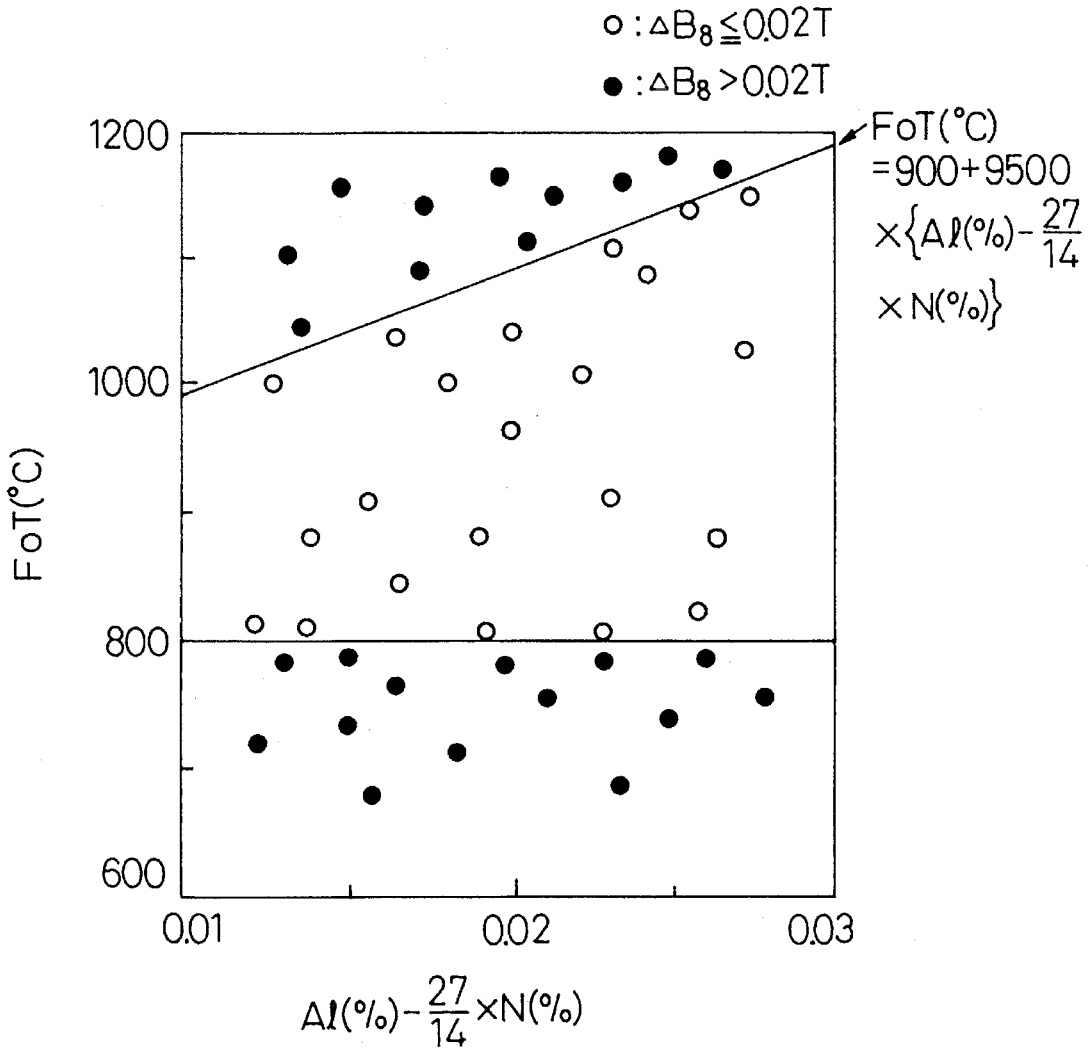
FIG. 2 is a graph showing the relationship between the acid-soluble Al quantity, the N quantity, a finish hot rolling starting temperature and the fluctuation of the magnetic flux density.

FIG. 2 shows the relationship between the Al (%) (−27/14)×N (%) quantity (where Al is acid-soluble Al), the finish hot rolling start temperature FoT (°C.) and the change in the flux density of the product.

As can be clearly seen from FIG. 2, the stable magnetic characteristics, $\Delta B_8 \leqq 0.02$ T could be obtained within the range of 800≦FoT (°C.)≦900+9,500×{Al (%)−(27/14)×N (%)}. Within this range, the hot rolled sheet satisfied the suitable range of N-N as AlN≦0.0030% and (N as AlN)/N≧0.55 shown in FIG. 1.

The mechanism of the effect of controlling the finish hot rolling starting temperature in such a manner as to correspond to the quantities of acid-soluble Al and N of the slab shown in FIG. 2 has not yet been sufficiently clarified, but the present inventors have made the following assumption.

The relation 800≦FoT (°C.)≦900+9,500×{Al (%)−(27/14)×N (%)} in FIG. 2 defines the finish hot rolling starting temperature in accordance with the quantities of acid-soluble Al and N of the slab. Here, the greater the value Al (%)−(27/14)×N (%), the smaller the quantity of N in solution at the start of finish hot-rolling. Therefore, in the case of a component system having a smaller quantity of N in solution, the allowable range of the finish hot-rolling start temperature is wider. The lower limit of FoT can be understood rather from the aspect of recrystallization at the time of hot rolling than from the aspect of precipitation of AlN. In other words, when finish hot-rolling is carried out at a temperature of less than 800° C., it is believed that recrystallization occurs with difficulty and consequently, the magnetic characteristics become unstable.

Next, the present inventors have further examined the fluctuation of the magnetic flux density of the product in the relationship between the Al (%)−(27/14)×N (%) quantity in the slab, the slab heating temperature ST (°C.) and the finish hot rolling starting temperature FoT (°C.) on the basis of the result shown in FIG. 2.

First, a slab comprising 0.025 to 0.038% of C, 2.6 to 3.2% of Si, 0.024 to 0.041% of acid-soluble Al, 0.0049 to 0.0075% of N, 0.005 to 0.007% of S, 0.10 to 0.14% of Mn in terms of a weight ratio, and the balance consisting of Fe and unavoidable impurities, and having a thickness of 250 mm, was produced.

After the slab was held at a temperature of 950° to 1,250° C. for about 90 minutes, rough hot rolling was effected in seven passes to attain a thickness of 40 mm, and then finish hot rolling was carried out in six passes to obtain a hot rolled sheet having a thickness of 2.3 mm. In this hot rolling, the finish hot rolling starting temperature was secured in a broad range by applying water cooling between the passes of rough hot rolling, changing the intervals between the passes or positively changing the interval between rough hot rolling and finish hot rolling.

Such a hot rolled sheet was subjected to high reduction rolling at a reduction ratio of about 85% without the annealing of hot rolled sheet and a cold rolled sheet having a final thickness of 0.335 mm was obtained. Decarbonization annealing was applied to this cold rolled sheet by soaking it for 150 seconds under the four conditions, that is, (1) at 810° C., (2) at 820° C., (3) at 830° C. and (4) at 840° C. Next, a $NH_3$ gas was mixed with the annealing atmosphere during annealing in which the decarbonized sheet was held at 750° C. for 30 seconds, so that the steel sheet was thus allowed to absorb nitrogen.

The N quantity after this nitriding treatment was 0.0183 to 0.0219 wt % and the mean grain size of the primary recrystallization grain (mean value of diameter of the circle with the same area as the grain has) was 20 to 27 μm. An annealing separating agent, consisting of MgO as the principal component, was applied to the steel sheet after the nitriding treatment, and final finish annealing was carried out. Thereafter, the flux density of the product was measured, and the difference $\Delta B_8$ between the maximum and minimum values of $B_8$ after the four decarbonization annealing conditions were employed for the cold rolled sheets having the same components and under the same hot rolling conditions, was determined.

Figure 3:
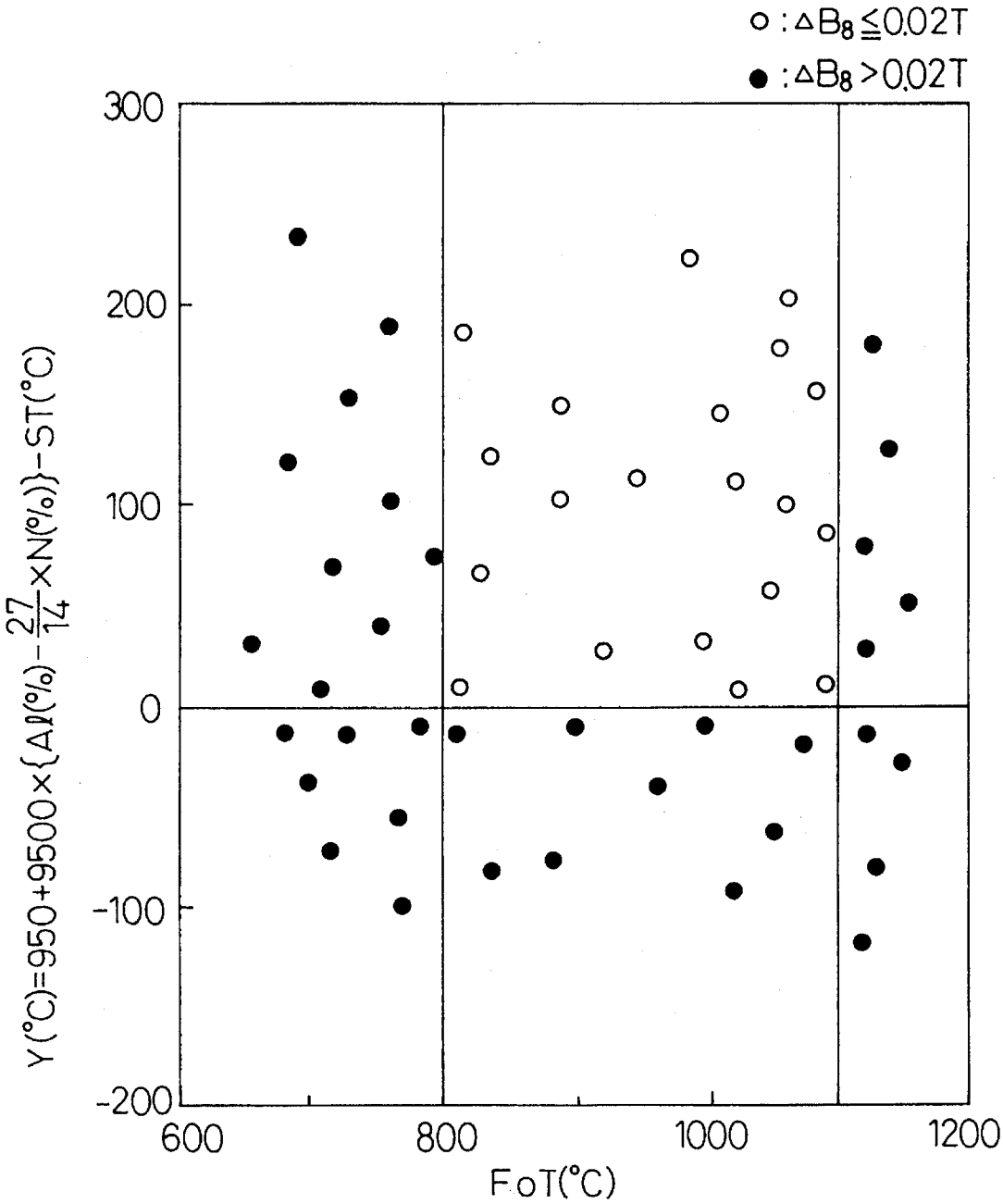
FIG. 3 is a graph showing the relationship between the acid-soluble Al quantity, the N quantity, a slab heating temperature, the finish hot rolling starting temperature and the fluctuation of the magnetic flux density.

FIG. 3 shows the relationship between the Al (%)−(27/14)×N (%) quantity (where Al is acid-soluble Al) in the slab, the slab heating temperature ST (°C.), the finish hot rolling starting temperature FoT (°C.) and the fluctuation of the magnetic flux density of the product. However, in the case of FIG. 3, the quantity Y (°C.)=950+9,500×(Al (%)−(27/14)×N (%)) was defined, this Y value was plotted on the ordinate and FoT (°C.) was plotted on the abscissa.

As can be clearly seen from FIG. 3, the stable magnetic properties, $\Delta B_8 \leqq 0.02$ T, could be obtained within the ranges of Y≧0 and 800≦FoT≦1,100. Under this range of condition, the suitable range shown in FIG. 1, that is, N—N as AlN≦0.0030% and (N as AlN)/N≧0.55, was satisfied.

The present inventors have further examined the observations shown in FIG. 3. Within the range of Y≧0 and 800≦FoT≦1,100 shown in FIG. 3, the relationship between the Al (%)−(27/14)×N (%) quantity in the slab, the finish hot rolling starting temperature FoT (°C.) and the flux density of the product was examined, and the result was shown in FIG. 4. As can be clearly seen from FIG. 4, within the range of FoT (°T)≦900+9,500×{Al (%)−(27/14)×N (%)}, more stable magnetic properties, $\Delta B_8 \leqq 0.01$ T, could be obtained in this range.

Figure 4:
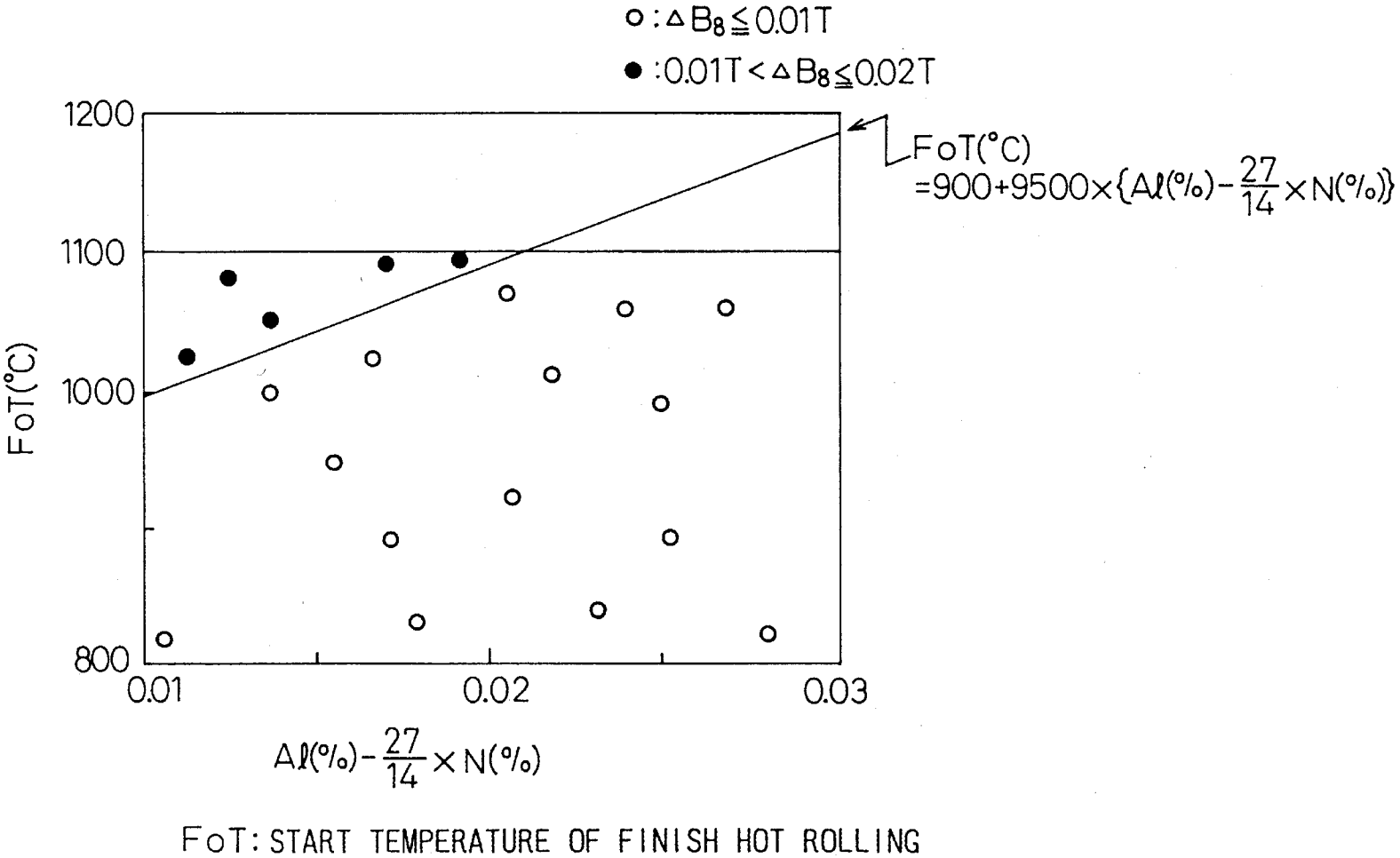
FIG. 4 is a graph showing the relationship between the acid-soluble Al quantity, the N quantity, the finish hot rolling starting temperature and the fluctuation of the magnetic flux density.

The mechanism of the effect of controlling the slab heating temperature and the finish hot rolling starting temperature in accordance with the quantity of acidsoluble Al and N in the slab shown in FIGS. 3 and 4 has not been sufficiently clarified, but the present inventors assume that the condition Y≧0 in FIG. 3 is equivalent to ST (°C.)≦950+9,500×{Al (%)−(27/14)×N (%)}, and means that the slab heating temperature is defined in accordance with the quantities of acid-soluble Al and N in the slab. Here, the greater the value Al (%)−(27/14)×N (%), the smaller becomes N quantity in solution at the time of heating of the slab. As described above, in the component system in which the quantity of N in solution is smaller, the allowable temperature range of the slab heating temperature is wider. Further, the upper limit of FoT can be understood as being necessary for keeping the sufficient amount of precipitation of AlN.

In other words, when FoT is higher than 1,100° C., the slab is hot rolled at a high speed under the condition of the excessive quantity of N in solution and is then taken up, the AlN precipitation quantity in the hot rolled sheet is believed to be small. The lower limit of FoT can be understood from the aspect of recrystallization rather than from the aspect of precipitation of AlN. In other words, when finish hot rolling is effected at a temperature less than 800° C., hot rolling recrystallization during hot-rolling occurs with difficulty, so that the magnetic properties may become unstable.

FIG. 4 shows that the upper limit value of the finish hot rolling starting temperature shown in FIG. 3 is determined in accordance with the quantities of acid-soluble Al and N of the slab. Here, the greater the value Al (%)−(27/14)×N (%), the smaller becomes the quantity of N in solution at the start of finish hot rolling. This means that the allowable range of the finish hot rolling starting temperature is wider in the case of a component system having a smaller quantity of N in solution.

Next, the present inventors examined the fluctuation of the magnetic flux density of the product in connection with the Al (%)–(27/14)×N (%) quantity in the slab and the difference AFoT (°C.) between the maximum and minimum finish hot rolling starting temperatures.

First, a slab comprising 0.024 to 0.031% of C, 2.5 to 3.0% of Si, 0.034 to 0.040% of acid-soluble Al, 0.0054 to 0.0068% of N, 0.005 to 0.007% of S, 0.10 to 0.14% of Mn in terms of a weight ratio, and the balance consisting of Fe and unavoidable impurities, and having a thickness of 250 mm, was produced. After the slab was held at a temperature of 1,050° to 1,200° C. for about 120 minutes, rough hot rolling was effected in seven passes to obtain a thickness of 40 mm, and then finish hot rolling was effected in six passes to obtain a hot rolled sheet having a thickness of 2.3 mm.

Figure 5:
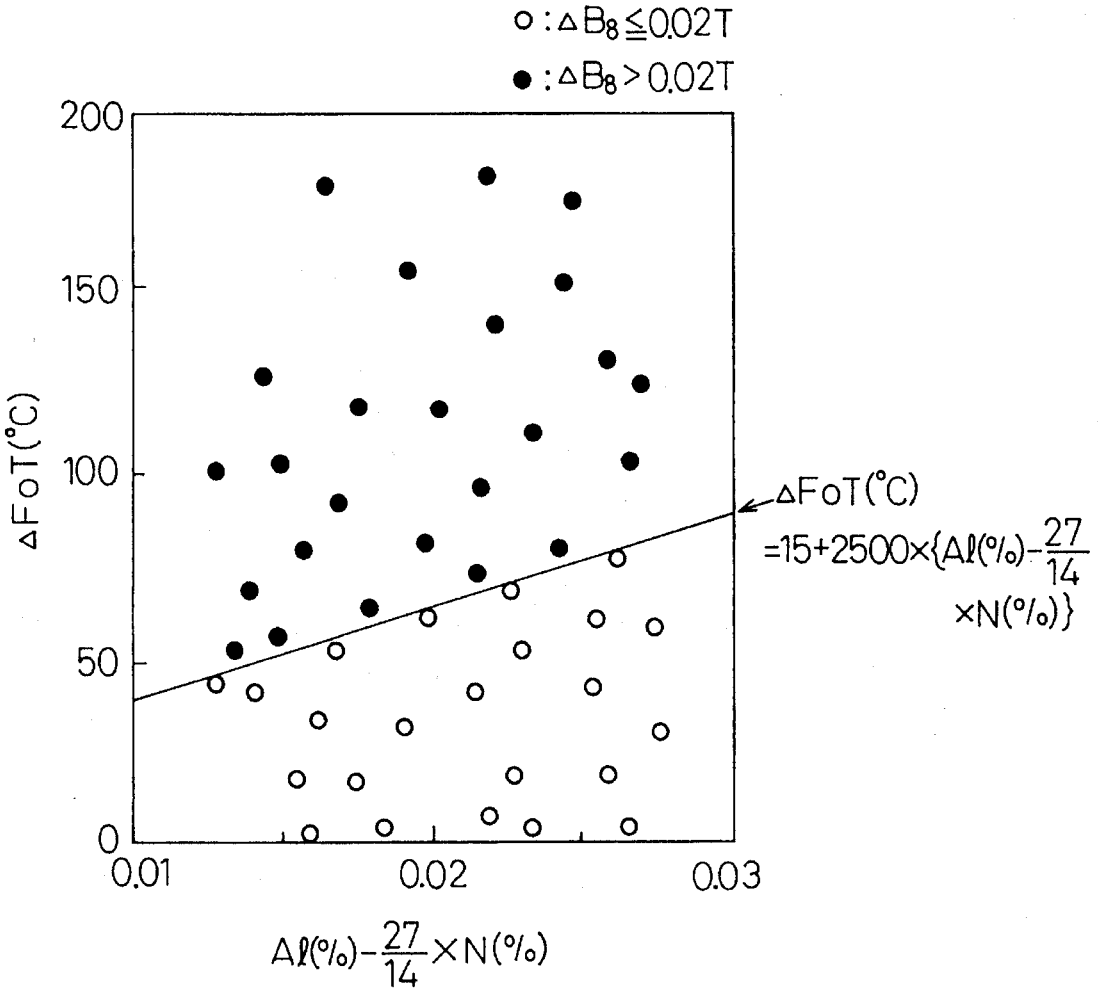
FIG. 5 is a graph showing the relationship between the acid-soluble Al quantity, the N quantity, deviation of the finish hot rolling starting temperature inside a coil and the fluctuation of the magnetic flux density.

FIG. 5 shows the relationship between the Al (%)–(27/14)×N (%) quantity in the slab, the difference AFoT (°C.) between the maximum and minimum temperatures of the finish hot rolling starting temperature, and the fluctuation of the magnetic flux density of the product.

In the hot rolling, the finish hot rolling start temperature was secured in a broad range by applying water cooling between the passes in rough hot rolling, changing the interval between the passes and positively changing the interval between rough hot rolling and finish hot rolling. The portion having the maximum finish hot rolling starting temperature and the portion having the minimum finish hot rolling starting temperature were cut out from the sample inside each coil of such a hot rolled sheet, and high reduction rolling was effected at a reduction ratio of about 85% without annealing of hot rolled sheet so as to obtain a cold rolled sheet having a final thickness of 0.335 mm. Decarbonization annealing was carried out by holding the cold rolled sheet at 835° C. for about 150 seconds. During annealing, in which the decarbonized sheet was held at 770° C. for 30 seconds, $NH_3$ gas was mixed with the annealing atmosphere so as to let the steel sheet absorb nitrogen.

The N quantity after this nitriding treatment was 0.0206 to 0.0237 wt %, and the mean grain size of the primary recrystallization grains (mean value of diameter of the circle with the same area as grain has) was 21 to 26 μm. An annealing separating agent consisting of MgO as the principal component was applied to the steel sheet after this nitriding treatment, and final finish annealing was carried out. Thereafter, the magnetic flux density of the product was measured, and the difference $\Delta B_8$ of the two samples (the highest temperature portion and the lowest temperature portion of the finish hot rolling starting temperature) sampled from the hot rolled sheet having the same component and under the same hot rolling condition.

As can be clearly seen from FIG. 5, stable magnetic characteristics $\Delta B_8 \leqq 0.02$ T could be obtained within the range of AFoT (°C.)$\leqq$15+2,500×{Al (%)–(27/14)×N (%)}. In this condition range, the suitable range shown in FIG. 1, that is, N—N as AlN$\leqq$0.0030% and (N as AlN)/N$\geqq$0.55, was satisfied in the hot rolled sheet. Though the mechanism of the effect of controlling the deviation of the finish hot rolling starting temperature in accordance with the quantities of acid-soluble Al and N in the slab shown in FIG. 5 has not yet been sufficiently clarified, the present inventors assume that the relation AFoT (°C.)$\leqq$15+2,500×{Al (%)–(27/14)×N (%)} in FIG. 5 means that the deviation of the finish hot rolling starting temperature is defined in accordance with the quantities of acid-soluble Al and N in the slab. Here, the greater the value Al (%)–(27/14)×N (%), the smaller the deviation of the quantity of N in solution caused by the temperature difference at the start of finish hot rolling. Accordingly, in the case of the component system having a smaller deviation in the quantity of N in solution, the allowable range of the finish hot rolling starting temperature deviation is greater.

Next, the reasons for the limitation of the constituent requirements in the present invention will be explained.

First, the reasons for limitations of the slab components will be explained in detail.

If C is excessive, the decarbonization time becomes uneconomically long. Therefore, the C amount is limited to not greater than 0.075 wt % (hereinafter, wt % will be simply called "%"). A particularly preferred range from the aspect of the magnetic properties is from 0.020 to 0.070%.

When the Si amount exceeds 4.5%, cracks during cold rolling become remarkable. Therefore, Si is limited to not greater than 4.5%. When it is less than 2.2%, the electrical resistance of the raw material is too low, and the low iron loss necessary in a transformer core material cannot be obtained. Therefore, the lower limit is set to 2.2%.

In order to keep the sufficient amount of AlN or (Al, Si)N necessary for stabilization of secondary recrystallization, at least 0.010% of acid-soluble Al is necessary. When the amount of acid-soluble Al exceeds 0.060%, AlN in the hot rolled sheet becomes unsuitable and secondary recrystallization becomes unstable. Therefore, the upper limit is set to not greater than 0.060%.

When the N amount exceeds 0.0130%, swelling of the steel sheet surface, referred to as "blister", occurs. Therefore, the upper limit is not greater than 0.0130%.

Even when MnS and MnSe exist in the steel, the magnetic properties can be improved by suitably selecting the condition of the production process. However, if the S and Se amounts are great, defect portions of secondary recrystallization tend to occur, and to prevent this secondary recrystallization defect, (S+0.405Se)$\leqq$0.014% should be satisfied.

When S or Se exceeds the upper limit value, the probability of the occurrence of the secondary recrystallization defects becomes undesirably high, in whichever way the production conditions may be changed, and the time necessary for purification during final finish annealing becomes undesirably long. From these aspects, it is meaningless to unnecessarily increase the amount of S or Se.

The lower limit value of Mn is 0.05%. If it is less than 0.05%, the shape (flatness) of the hot rolled sheet obtained by hot rolling, that is, the side edge portions of the strip, become corrugated, and the production yield drops. When the Mn amount exceeds 0.8%, on the other hand, the magnetic flux density of the product undesirably decreases. Therefore, the upper limit of the Mn amount is set to 0.8%.

Sn is known as one of the grain boundary segregation elements, and is an element which restricts the grain growth. On the other hand, Sn is in a completely solid-solution state at the time of heating of the slab, and is believed to be in a uniform solid-solution state inside the slab, at the time of heating, having a temperature difference of dozens degrees centigrade which is ordinarily presumed. Accordingly, Sn, which is uniformly distributed inside the slab at the time of heating despite the temperature difference, is believed to act uniformly, position-wise, on the grain growth inhibition effect at the time of decarbonization annealing. Accordingly, Sn is believed to have the effect of diluting the positional non-uniformity of the grain growth during decarbonization annealing which results from positional non-uniformity of AlN. Therefore, the addition of Sn is effective for further reducing the fluctuation of the magnetic properties of the product.

The suitable range of Sn is set to 0.01 to 0.15%. If the Sn amount is less than this lower limit value, the grain growth inhibition effect becomes undesirably low. On the other hand, if the Sn amount exceeds the upper limit value, nitriding of the steel sheet becomes difficult, and secondary recrystallization defects will occur.

Trace amounts of Sb, Cu, Cr, Ni, B, Ti, Nb, etc., which are known as inhibitor constitution elements, may be contained in the steel. Particularly, nitride formation elements such as B, Ti, Nb, etc., may be positively added in order to reduce the quantity of N in solution in the steel at the time of heating of the slab. When these elements having higher affinity with N than with Al exist, it is preferred from the aspect of improvement of accuracy of the effect in the present invention to subtract the N quantity of the nitrides formed by B, Ti and Nb from the total N quantity when the value N—N as AlN, (N as AlN)/N in the hot rolled sheet is calculated.

Next, the production method of the present invention will be explained.

To effect hot rolling of the slab having the chemical components described above, heating is carried out, but the slab heating temperature is set to be less than 1,280° C. equivalent to that of ordinary steels so as to reduce the heating cost. The slab heating temperature is preferably not higher than 1,200° C.

The slab so heated is subsequently hot rolled to a hot rolled sheet. The hot rolling step generally comprises rough hot rolling in which a 100 to 400 mm-thick slab is heated and rolled in a plurality of passes, and finish hot rolling effected similarly in a plurality of passes. The rough hot rolling method is not particularly limited, and means such as positive water cooling after rough hot rolling is preferred so as to promote the precipitation of AlN. The time from rough hot rolling to finish hot rolling is not particularly limited, but starting the finish hot rolling after an interval of at least one second is preferred from the aspect of promoting the precipitation of AlN.

Subsequent finish hot rolling is generally carried out as high speed continuous rolling in four to ten passes. Generally, distribution of reduction is such that a reduction ratio is high during the early passes and is progressively reduced during the later passes so as to obtain a good shape. The rolling speed is generally 100 to 3,000 m/min and the interval between the passes is 0.01 to 100 seconds.

The present invention does not limit the condition of finish hot rolling, but in order to accomplish the appropriate range of AlN precipitation in the hot rolled sheet which will be described later, adjustment of the finish hot rolling starting temperature and its finish temperature and adjustment of reduction distribution should be positively carried out. It is an effective means for controlling the AlN precipitation quantity to positively increase the reduction ratio in the temperature range (800° to 950° C.) or in the proximity thereof so as to cause deformation-induced precipitation.

After the final pass of hot rolling, the steel sheet is ordinarily cooled by air for about 0.1 to 100 seconds and is then cooled by water, is taken up at a temperature of 300° to 700° C., and is slowly cooled. This cooling process is not particularly limited, but it is preferred to utilize a method which effects air cooling for at least one second after hot rolling and keeps the steel sheet inside the precipitation temperature zone of AlN as long as possible, for controlling the AlN precipitation quantity.

The quantity of N as AlN in the steel sheet after such hot rolling must satisfy the relation N—N as AlN≦0.0030% and (N as AlN)/N≧0.55. Excellent magnetic properties can be stably obtained by controlling the AlN precipitation quantity within this range.

Hereinafter, the most preferred production conditions for the present invention will be described.

First of all, the cumulative reduction ratio of rough rolling must be at least 60%. In the case of AlN precipitation control technology as in the present invention, a great quantity of dislocations must be introduced as precipitation nuclei for AlN. When the cumulative reduction ratio is less than 60%, the number of dislocations is not sufficient. Therefore, the lower limit is set to at least 60%. The upper limit of this cumulative reduction ratio is not particularly limited and up to about 99.9% is allowable.

The time interval between the rough hot rolling pass and the finish hot rolling pass must be at least one second because precipitation of AlN is allowed to occur between these passes. If the interval is less then one second, this effect is lowered. The upper limit of the pass interval time is not particularly limited, but an interval as long as one hour or more is not preferred from the aspect of productivity.

Second, the finish hot rolling starting temperature FoT (°C.) is controlled in such a manner as to satisfy the following formula:

$$800 \leqq \text{FoT (°C.)} \leqq 900+9{,}500\times\{\text{Al (\%)}-(27/14)\times\text{N (\%)}\} \quad (1)$$

This range is necessary for stabilizing the magnetic characteristics as shown in FIG. 2.

Means for bringing the finish hot rolling starting temperature to the range described above is not particularly limited. For example, a method which regulates the slab heating temperature, regulates of the interval between the passes of rough hot rolling, regulates of the interval between the passes of rough hot rolling and finish hot rolling controls cooling of rough hot rolling and its passes, controls the temperature by temperature retention or water cooling between rough hot rolling and finish hot rolling, etc., can be used.

Thirdly, the slab heating temperature ST (°C.) must be so controlled as to satisfy the following formula (2) in conjunction with the quantities of acid-soluble Al and N of the slab:

$$\text{ST (°C.)} \leqq 950+9{,}500\times\{\text{Al (\%)}-(27/14)\times\text{N (\%)}\} \quad (2)$$

where Al: acid-soluble Al.

This is necessary for stabilizing the magnetic properties as shown in FIG. 3. The lower limit of the slab heating temperature is not particularly limited, but heating is preferably carried out at at least 800° C. in consideration of finish hot rolling starting temperature control and reduction of the load in hot rolling which will be described later.

Further, the finish hot rolling starting temperature FoT (°C.) must be from 800° to 1,100° C. This is necessary for stabilizing the magnetic characteristics as shown in FIG. 3. Further preferably, the upper limit of the finish hot rolling starting temperature FoT (°C.) is so set as to satisfy the relation FoT (°C.)≦900+9,500×{Al (%)−(27/14)×N (%)} in accordance with the acid-soluble Al quantity (expressed as "Al (%)") and the N quantity (expressed as "N (%)") of the slab. The magnetic properties can be further stabilized within this range as shown in FIG. 4. By the way, FIG. 4 shows the range of FoT (°C.) in the same way as FIG. 2.

Means for bringing the finish hot rolling start temperature into the range described above is not particularly limited. Besides the regulation of the slab heating temperature within the range of the formula (2), regulation of the interval between the passes of rough hot rolling, regulation of the interval between the passes of rough hot rolling and finish hot rolling, cooling control of rough hot rolling and between its passes, temperature control between rough hot rolling and finish hot rolling by temperature retention or water cooling, and so forth, can be used.

Fourthly, the finish hot rolling starting temperature deviation ΔFoT (°C.) must satisfy the relation ΔFoT (°C.)≦15+2,500×{Al (%)−(27/14)×N (%)}. This is necessary for stabilizing the magnetic properties as shown in FIG. 5. Means for bringing the deviation of the finish hot rolling starting temperature deviation into the range described above is not particularly limited. For example, a method which regulates the slab temperature by a temperature gradient, a method which changes the thickness of the sheet at completion of rough hot rolling in the rolling direction, regulation of the interval between the passes of rough hot rolling, regulation of the interval between the passes of rough hot rolling and finish hot rolling, cooling control inside the coil in accordance with positions in rough hot rolling and between its passes, temperature control in accordance with positions by temperature retention or water cooling between rough hot rolling and finish hot rolling, and so forth, can be executed.

The hot rolled sheet is then subjected to final cold rolling without the annealing of hot rolled sheet at a reduction ratio of at least 80%. The reason why the reduction ratio of final cold rolling is set to at least 80% is because suitable quantities of sharp ({110}<001> orientation) grains and coincidence orientated grains (such as {111}<112> oriented grains), which are likely to be invaded by the former, can be obtained in the decarbonized sheet, and the magnetic flux density can be improved.

Decarbonization annealing, application of the annealing separating agent, final finish annealing, etc., are thereafter applied to the steel sheet after cold rolling by an ordinary method, and the final product is obtained. In this instance, it is necessary to control the mean grain size of the primary recrystallization grains from completion of decarbonization annealing to the start of final finish annealing to 18 to 35 μm. An excellent flux density can be obtained within this range of mean grain sizes so that the change of the magnetic flux density with respect to the change of the grain size becomes small.

The reason why nitriding treatment must be applied between hot rolling and the start of secondary recrystallization of final finish annealing is because the inhibitor strength necessary for secondary recrystallization becomes insufficient in a process, such as the process of the present invention, which is based on the premise that slab is heated at low temperature.

The nitriding method is not particularly limited. For example, a method which causes nitriding by mixing the $NH_3$ gas into the annealing atmosphere subsequent to decarbonization annealing, a method which uses plasma, a method which adds a nitride to the annealing separating agent and allows the steel sheet to absorb nitrogen formed by the separation of the nitride during elevating the temperature of final finish annealing, a method which nitrides the steel sheet by setting a $N_2$ partial pressure of the atmosphere of final finish annealing to a high level, etc., can be employed. At least 10 ppm is necessary as the nitriding quantity in order to stably cause secondary recrystallization.

EXAMPLES

Example 1

A slab containing 3.01% of Si, 0,028% of C, 0.034% of acid-soluble Al, 0.0065% of N, 0.12% of Mn and 0.007% of S by weight percent and having a thickness of 250 mm was held retained for one hour at (1) 1,250° C. and (2) 1,100° C. and was subjected to rough hot rolling, in seven passes, to a thickness of 40 mm. Thereafter, finish hot rolling was carried out, in six passes, to obtain hot rolled sheets having a thickness of 2.3 mm. In this case, hot rolling was effected in the following two ways, that is, (A) a hot rolling method which effected compulsive water cooling during rough hot rolling and lowered the finish hot rolling starting temperature by 90° to 100° C. from the slab heating temperature, and (B) a hot rolling method which effected milder water cooling than the method (A) and lowered the finish hot rolling starting temperature by 30° to 50° C. from the slab heating temperature.

Each hot rolled sheet was pickled and was cold rolled, at a reduction ratio of about 85%, so as to obtain a cold rolled sheet having a thickness of 0.335 mm. Then, decarbonization annealing (25% $N_2$+75$H_2$, dew point=62° C.), by holding each sheet for 150 seconds under the four temperature conditions, that is, (1) 810° C., (2) 820° C., (3) 830° C. and (4) 840° C., was effected, and annealing was then effected by holding each sheet at 750° C. for 30 seconds. A $NH_3$ gas was mixed into the annealing atmosphere so as to allow the steel sheet to absorb nitrogen. The N quantity of the steel sheet after nitriding was 0.0185 to 0.0245%, and the mean grain size of the primary recrystallization grains of the steel sheets was 20 to 28 μm. Next, an annealing separating agent, consisting of MgO as the principal component, was applied to each steel sheet, and final finish annealing was carried out by a known method. N as AlN of the hot rolled sheet was chemically analyzed, and N—N as AlN and (N as AlN)/N were calculated. Table 1 shows the experimental condition and the result of the magnetic properties.

TABLE 1

| No. | slab heating | hot rolling | hot rolled sheet N-N as Aln (%) | hot rolled sheet (N as AlN)/N | $B_8$ range within 4 decarbonization annealing conditions (T) | remarks |
|---|---|---|---|---|---|---|
| 1 | 1 | A | 0.0025 | 0.62 | 1.89–1.91 | This Invention |
| 2 | 1 | B | 0.0034 | 0.48 | 1.82–1.89 | Comp. Example |
| 3 | 2 | A | 0.0017 | 0.74 | 1.90–1.92 | This Invention |
| 4 | 2 | B | 0.0022 | 0.66 | 1.89–1.91 | " |

Example 2

A slab containing 3.15% of Si, 0.035% of C, 0.032% of acid-soluble Al, 0.0060 & of N, 0.13% of Mn and 0.007% of S in terms of a weight percent and having a thickness of 250 mm was held at 1,150° C. for one hour and was subjected to rough hot rolling in seven passes to a thickness of 40 mm. Finish hot rolling was then effected in six passes and a hot rolled sheet having a thickness of 2.3 mm was obtained. At this time, hot rolling was effected in the following three ways, that is, (A) a hot rolling method which effected compulsive water cooling after rough hot rolling and lowered the finish hot rolling starting temperature by 70° to 80° C. from the slab heating temperature, (B) a hot rolling method which did not effect water cooling of the method (A) but lowered the finish hot rolling starting temperature by 30° to 50° C. from the slab heating temperature, and (C) a hot rolling method which effected air cooling for 30 seconds after rough hot rolling and lowered the finish hot rolling starting temperature by 65° to 75° C. from the slab heating temperature.

Each hot rolled sheet was pickled and was cold rolled at a reduction ratio of about 88% to obtain a cold rolled sheet having a thickness of 0.285 mm. Then, decarbonization annealing (25% $N_2$+25% $H_2$, dew point=62° C.), by holding each steel sheet for 150 seconds under the four temperature conditions, that is, (1) 810° C., (2) 820° C., (3) 830° C. and (4) 840° C., was effected, and annealing was then carried out by holding the steel sheets at 750° C. for 30 seconds. An $NH_3$ gas was mixed into the annealing atmosphere so as to allow the steel sheet to absorb nitrogen. The N quantity after nitriding was 0.0190 to 0.0231%, and the mean grain size of the primary recrystallization grains of the steel sheet was 21 to 27 μm. Next, an annealing separating agent, consisting of MgO as the principal component, was applied to each steel sheet, and final finish annealing was carried out by a known method. N as AlN of the hot rolled sheet was chemically analyzed, and N—N as AlN and (N as AlN)/N were calculated. Table 2 shows the experimental condition and the result of the magnetic properties.

TABLE 2

| No. | hot rolling | hot rolled sheet N-N as AlN (%) | hot rolled sheet (N as AlN)/N | $B_8$ range under 4 decarbonization annealing conditions (T) | remarks |
|---|---|---|---|---|---|
| 1 | 1 | 0.0024 | 0.60 | 1.89–1.91 | This Invention |
| 2 | 2 | 0.0032 | 0.47 | 1.84–1.88 | Comp. Example |
| 3 | 3 | 0.0026 | 0.57 | 1.90–1.91 | This Invention |

Example 3

Three kinds of slabs containing 2.85% of Si, 0.031% of C, 0.035% of acid-soluble Al, 0.0058% of N, 0.11% of Mn, 0.006% of S and further (1) Sn<0.005%, (2) Sn: 0.06% and (3) Sn: 0.11%, in terms of a weight ratio, and having a thickness of 250 mm, were held at 1,050° C. for one hour and were subjected to rough hot rolling, in seven passes, to a thickness of 30 mm. Finish hot rolling was then carried out, in six passes, and hot rolled sheets 2.8 mm thick were obtained. At this time, hot rolling was effected in the following two ways, that is, (A) a rolling method which effected compulsive water cooling between the passes of rough hot rolling and lowered the finish hot rolling starting temperature by 80° to 90° C. from the slab heating temperature, and (B) a hot rolling method which did not effect water cooling of the method (A) but lowered the finish hot rolling temperature by 30° to 50° C. from the slab heating temperature.

Each hot rolled sheet was pickled and was cold rolled at a reduction ratio of about 84% so as to obtain a cold rolled sheet having a thickness of 0.46 mm. Thereafter, decarbonization annealing (25% $N_2$+75% $H_2$, dew point=62° C.) by holding the steel sheet for 250 seconds under four temperature conditions, that is, (1) 810° C., (2) 820° C., (3) 830° C. and (4) 840° C., was effected, and then annealing was effected by holding each steel sheet at 750° C. for 30 seconds. A $NH_3$ gas was mixed into the annealing atmosphere so as to allow the steel sheet to absorb nitrogen. The N quantity of the steel sheet after this nitriding treatment was 0.0220 to 0.0242%, and the mean grain size of the primary recrystallization grains of the steel sheet was 21 to 28 μm. Next, an annealing separating agent, consisting of MgO as the principal component, was applied to the steel sheet, and final finish annealing was carried out by a known method. N as AlN of the hot rolled sheet was chemically analyzed an n-N as AlN and (N as AlN)/N were calculated. Table 3 shows the experimental condition and the results of the magnetic properties.

TABLE 3

| No. | component | hot rolling | hot rolled sheet N-N as AlN (%) | hot rolled sheet (N as AlN)/N | $B_8$ range under 4 decarbonization annealing conditions (T) | remarks |
|---|---|---|---|---|---|---|
| 1 | 1 | A | 0.0022 | 0.62 | 1.89–1.91 | This Invention |
| 2 | 1 | B | 0.0025 | 0.57 | 1.89–1.91 | " |
| 3 | 2 | A | 0.0023 | 0.60 | 1.91–1.92 | " |
| 4 | 2 | B | 0.0025 | 0.57 | 1.90–1.91 | " |
| 5 | 3 | A | 0.0024 | 0.59 | 1.91–1.92 | " |
| 6 | 3 | B | 0.0025 | 0.57 | 1.90–1.91 | " |

Example 4

When Z (°C.)=900+9,500×{Al (%)−(27/14)×N (%)} was calculated for a slab containing 3.05% of Si, 0.036% of C, 0.032% of acid-soluble Al, 0.0060% of N, 0.14% of Mn and 0.006% of S and having a thickness of 250 mm, it was found to be 1,094. It was predicted from FIG. 2 that the finish hot rolling starting temperature should be within 800° to 1,094° C. in order to obtain excellent magnetic properties. Accordingly, a slab was held for 90 minutes at (1) 1,100° C. and for comparison, another slab was held for 90 minutes at (2) 1,250° C. Thereafter, each slab was rough hot rolled, in seven passes, to a thickness of 40 mm (cumulative reduction ratio: 84%), and was cooled by air for 15 seconds until the start of finish hot rolling. Then, finish hot rolling was carried out in six passes and a hot rolled sheet having a thickness of 2.3 mm was obtained. At this time, the finish hot rolling starting temperature were (1) 1,002° C. and (2) 1,142° C. for each slab heating temperature.

After each of these hot rolled sheets was pickled and was cold rolled at a reduction ratio of about 85% so as to obtain a cold rolled sheet having a thickness of 0.335 mm. Then, decarbonization annealing (25% $N_2$+75% $H_2$, dew point=62° C.) by holding the rolled sheet for 150 seconds under four temperature conditions, that is, (1) 810° C., (2) 820° C., (3) 830° C. and (4) 840° C., was effected, and annealing was then carried out by holding each rolled sheet at 770° C. for 30 seconds. A $NH_3$ gas was mixed into the annealing atmosphere so as to allow the steel sheet to absorb nitrogen. The N quantity after this nitriding treatment was 0.0198 to 0.0212%, and the mean grain size of the primary recrystallization grains of the steel sheet was 19 to 28 μm.

Next, an annealing separating, agent consisting of MgO as the principal component, was applied to this steel sheet, and final finish annealing was carried out by a known method. FIG. 4 shows the experimental conditions and the results of the magnetic properties.

By the way, the slab heating condition (1) satisfied the condition N—N as AlN≦0.0030% and (N as AlN/N)≧0.55 in the hot rolled sheet, but the slab heating condition (2) failed to satisfy this condition of AlN.

TABLE 4

| No. | slab heating | $B_8$ range under 4 decarbonization annealing conditions (T) | remarks |
|---|---|---|---|
| 1 | 1 | 1.90–1.91 | This Invention |
| 2 | 2 | 1.83–1.88 | Comp. Example |

Example 5

When Z (°C.)=900+9,500×{Al (%)−(27/14)×N (%)} was calculated for a slab containing 2.89% of Si, 0.028% of C, 0.029% of acid-soluble Al, 0.068% of N, 0.14% of Mn and 0.007% of S in terms of a weight ratio, it was found to be 1,051. It was predicted from FIG. 2 that the finish hot rolling start temperature should be within the range of 800° to 1,051° C. in order to obtain excellent magnetic properties. Accordingly, (1) the slab was held at 1,150° C. for 60 minutes, was then rough hot rolled, in seven passes, to a thickness of 50 mm (cumulative reduction ratio: 80%), was cooled by air for 20 seconds till the start of finish hot rolling, and was subjected to finish hot rolling, in six passes, to obtain a hot rolled sheet having a thickness of 1.2 mm. The finish hot rolling starting temperature at this time was 1,038° C. For comparison, (2) the slab having the same components was held at 1,150° C. for 60 minutes and was rough hot rolled, in seven passes, to a thickness of 60 mm (cumulative reduction ratio: 76%). Thereafter, a temperature-retaining cover was put on the steel sheet for 10 seconds till the start of finish hot rolling, and after heating was effected by a burner inside the heat-retaining cover, finish hot rolling was carried out in six passes and a hot rolled sheet having a thickness of 2.3 mm was obtained. The finish hot rolling starting temperature at this time was 1,107° C.

Each of these hot rolled sheets was pickled without applying hot rolled sheet annealing and was cold rolled at a reduction ratio of about 85% so as to obtain a cold rolled sheet having a thickness of 0.335 mm. Thereafter, decarbonization annealing (25% $N_2$+75% $H_2$, dew point=60° C.) by holding each sheet for 150 seconds under the four temperature conditions, that is, (1) 810° C., (2) 820° C., (3) 830° C. and (4) 840° C., was effected, and annealing was then carried out by holding each steel sheet at 750° C. for 30 seconds. A $NH_3$ gas was mixed into the annealing atmosphere so as to allow the steel sheet to absorb nitrogen. The N quantity after this nitriding treatment was 0.0215 to 0.0228%, and the mean grain size of the primary recrystallization grains of the steel sheet was 21 to 30 μm. Next, an annealing separating agent, consisting of MgO as the principal component, was applied to this steel sheet, and final finish annealing was carried out by a known method. Table 5 shows the experimental conditions and the results of the magnetic properties. By the way, the hot rolling condition (1) satisfied the condition N—N as AlN≦0.0030% and (N as AlN)/N≦0.55 in the hot rolled sheet, but the hot rolling condition (2) failed to satisfy this condition of AlN.

TABLE 5

| No. | hot rolling | $B_8$ range under 4 decarbonization annealing conditions (T) | remarks |
|---|---|---|---|
| 1 | 1 | 1.90–1.92 | This Invention |
| 2 | 2 | 1.84–1.89 | Comp. Example |

Example 6

When Z (°C.)=900+9,500×{Al (%)−(27/14)×N (%)} was calculated for two kinds of slabs containing 3.12% of Si, 0.034% of C, 0.025% of acid-soluble Al, 0.0074% of N, 0.14% of Mn, 0.007% of S and further (1) Sn<0.005% and (2) Sn: 0.05% in terms of weight percent and having a thickness of 150 mm, it was found to be 1,002. It was predicted from FIG. 2 that the finish hot rolling starting temperature should be within the range of 800° to 1,002° C. in order to obtain excellent magnetic properties. Therefore, (A) the slab was held at 1,000° C. for 60 minutes, was rough hot rolled, in seven passes, to a thickness of 50 mm (cumulative reduction ratio: 67%), was cooled in air for 15 seconds till the start of finish hot rolling and was finish hot rolled so as to obtain a hot rolled sheet having a thickness of 2.3 mm.

The finish hot rolling start temperature at this time was 895° C. For comparison, (B) the slab having the same components was held at 1,000° C. for 60 minutes, and was rough hot rolled, in seven passes, to a thickness of 65 mm (cumulative reduction ratio: 57%), was then cooled by air for 15 seconds till the start of finish hot rolling, and was finish hot rolled, in six passes, so as to obtain a hot rolled sheet having a thickness of 2.3 mm. The finish hot rolling start temperature at this time was 923° C. For comparison, furthermore (C) the slab having the same components was held at 1,000° C. for 60 minutes, was rough hot rolled, in seven passes, to a thickness of 30 mm (cumulative reduction ratio: 80%), was then cooled by water for 25 seconds till the start of finish hot rolling, and was finish hot rolled, in six passes, so as to obtain a hot rolled sheet having a thickness of 2.3 mm. The finish hot rolling starting temperature at this time was 782° C.

Each of these hot rolled sheets was pickled without hot rolled sheet annealing, and was cold rolled at a reduction ratio of about 88%. Thereafter, decarbonization annealing (25% $N_2$+75% $H_2$, dew point=64° C.) by holding each sheet for 150 seconds under four temperature conditions, that is, (1) 810° C., (2) 820° C., (3) 830° C. and (4) 840° C., was effected, and then annealing by holding each steel sheet at 750° C. for 30 seconds was carried out. An $NH_3$ gas was mixed into the annealing atmosphere so as to allow the steel sheet to absorb nitrogen. The N quantity of the steel sheet after this nitriding treatment was 0.0221 to 0.0239%, and the mean grain size of the primary recrystallization grains of the steel sheet was 19 to 30 μm. Next, an annealing separating agent consisting of MgO as the principal component was applied to this steel sheet, and final finish annealing was carried out by a known method. Table 6 shows the experimental conditions and the results of the magnetic properties. By the way, the conditions No. 1 and No. 4 in Table 6 satisfied the condition N—N as AlN≦0.0030% and (N as AlN)/N≧0.55 in the hot rolled sheet, but the other conditions failed to satisfy this AlN condition.

TABLE 6

| No. | component | hot rolling | $B_8$ range under 4 decarbonization annealing conditions (T) | remarks |
|---|---|---|---|---|
| 1 | 1 | A | 1.90–1.92 | This Invention |
| 2 | 1 | B | 1.84–1.88 | Comp. Example |
| 3 | 1 | C | 1.83–1.89 | " |
| 4 | 2 | A | 1.92–1.94 | This Invention |
| 5 | 2 | B | 1.85–1.89 | Comp. Example |
| 6 | 2 | C | 1.84–1.90 | " |

Example 7

When Z (°C.)=950+9,500×{Al (%)−(27/14)×N (%)} was calculated for a slab containing 3.15% of Si, 0.034% of C, 0.035% of acid-soluble Al, 0.0063% of N, 0.13% of Mn and 0.007% of S in terms of a weight ratio and having a thickness of 250 mm was calculated, it was found to be 1,167. It was predicted from FIG. 3 that the slab heating temperature should be up to 1,167° C. in order to obtain excellent magnetic properties. Accordingly, after the slab was held for 90 minutes at (1) 1,100° C. and for comparison, at (2) 1,200° C., it was rough hot rolled in seven passes to a thickness of 40 mm (cumulative reduction ratio: 84%), and then cooled in air for 10 seconds till the start of finish rolling, and was finish hot rolled, in six passes, so as to obtain a hot rolled sheet having a thickness of 2.3 mm. The finish hot rolling starting temperature at this time was (1) 1,002° C. and (2) 1,098° C. for each slab heating temperature.

Each of these hot rolled sheets was pickled and was cold rolled at a reduction ratio of about 85%. Then, decarbonization annealing (25% $N_2$+75% $H_2$, dew point=62° C.) by holding each sheet for 150 seconds under the four temperature conditions, that is, (1) 810° C., (2) 820° C., (3) 830° C. and (4) 840° C., was effected, and annealing was then carried out by holding each steel sheet at 770° C. for 30 seconds. An $NH_3$ gas was mixed into the annealing atmosphere so as to allow the steel sheet to absorb nitrogen. The N quantity after this nitriding treatment was 0.0221 to 0.0242%, and the mean grain size of the primary recrystallization grains of the steel sheet was 21 to 27 μm.

Next, an annealing separating agent, consisting of MgO as the principal component, was applied to this steel sheet, and final finish annealing was carried out by a known method.

Table 7 shows the experimental conditions and the results of the magnetic properties. By the way, the slab heating condition (1) satisfied the condition N—N as AlN≦0.0030% and (N as AlN)/N≧0.55 in the hot rolled sheet, but the slab heating condition (2) failed to satisfy this AlN condition.

TABLE 7

| No. | slab heating | $B_8$ range under 4 decarbonization annealing conditions (T) | remarks |
|---|---|---|---|
| 1 | 1 | 1.90–1.91 | This Invention |
| 2 | 2 | 1.85–1.89 | Comp. Example |

Example 8

When Z (°C.)=950+9,500×{Al (%)−(27/14)×N (%)} was calculated for a slab containing 2.85% of Si, 0.029% of C, 0.035% of acid-soluble Al, 0.0060% of N, 0.14% of Mn and 0.006% of S in terms of a weight ratio and having a thickness of 250 mm, it was found to be 1,173. It was predicted from FIG. 3 that the slab heating temperature should be up to 1,173° C. in order to obtain excellent magnetic characteristics. Accordingly, (1) the slab was held at 1,150° C. for 60 minutes, was rough hot rolled in seven passes to a thickness of 60 mm (cumulative reduction ratio: 76%), was cooled in air for 10 seconds till the start of finish hot rolling and was finish hot rolled in six passes so as to obtain a hot rolled sheet having a thickness of 2.3 mm. The finish hot rolling starting temperature at this time was 1,042° C. For comparison, (2) the slab having the same components was held at 1,150° C. for 60 minutes, and was rough hot rolled in seven passes to a thickness of 60 mm (cumulative reduction ratio: 76%). Thereafter, a heat-retaining cover was put on the steel sheet for 10 seconds till the start of finish hot rolling, and the steel was heated by a burner inside the heat-retaining cover. Thereafter, finish hot rolling was carried out so as to obtain a hot rolled sheet having a thickness of 2.3 mm. The finish hot rolling starting temperature at this time was 1,115° C.

Each of these hot rolled sheets was pickled without applying hot rolled sheet annealing, and was cold rolled at a reduction ratio of about 88% so as to obtain a cold rolled sheet having a thickness of 0.285 mm. Then, decarbonization annealing (25% $N_2$+75% $H_2$, dew point=64° C.) by holding each steel sheet for 150 seconds at the four temperature conditions, that is, (1) 810° C., (2) 820° C., (3) 830° C. and (4) 840° C., was effected, and annealing was then carried out by holding each steel sheet at 750° C. for 30 seconds. An $NH_3$ gas was mixed into the annealing atmosphere so as to allow the steel sheet to absorb nitrogen. The N quantity of this steel sheet after this nitriding treatment was 0.0223 to 0.0242%, and the mean grain size of the primary recrystallization grains of the steel sheet was 22 to 28 μm.

Next, an annealing separating agent consisting of MgO as the principal component was applied to this steel sheet, and final finish annealing was carried out by a known method.

Table 8 shows the experimental condition and the results of the magnetic properties. By the way, the hot rolling condition (1) satisfied the condition N—N as AlN≦0.0030% and (N as AlN)/N≧0.55 in the hot rolled sheet, but the hot rolling condition (2) failed to satisfy this AlN condition.

TABLE 8

| No. | hot rolling | $B_8$ range under 4 decarbonization annealing conditions (T) | remarks |
|---|---|---|---|
| 1 | 1 | 1.91–1.93 | This Invention |

TABLE 8-continued

| No. | hot rolling | $B_8$ range under 4 decarbonization annealing conditions (T) | remarks |
|---|---|---|---|
| 2 | 2 | 1.86–1.90 | Comp. Example |

Example 9

When Z (°C.)=950+9,500×{Al (%)−(27/14)×N (%)} was calculated for a slab containing 3.15% of Si, 0.039% of C, 0.028% of acid-soluble Al, 0.0080% of N, 0.13% of Mn and 0.007% of S in terms of a weight percent and having a thickness of 250 mm, it was found to be 1,069. It was predicted from FIG. 3 that the slab heating temperature shown be up to 1,069° C. in order to obtain excellent magnetic properties. It was further predicted from FIG. 3 that the finish hot rolling start temperature should be within the range of 800° to 1,100° C. in order to obtain excellent magnetic properties. Next, when W (°C.)=900+9,500×{Al (%)−(27/14)×N (%)} was calculated, it was found to be 1,019. It was further predicted from FIG. 4 that the finish hot rolling starting temperature should preferably be up to 1,019° C. in order to obtain excellent magnetic properties.

Accordingly, (A) after the slab was held at 1,050° C. for 60 minutes, it was rough hot rolled in seven passes to a thickness of 40 mm (cumulative reduction ratio: 84%), was cooled in air for 15 seconds till the start of finish hot rolling, and was finish hot rolled in six passes so as to obtain a hot rolled sheet having a thickness of 2.3 mm. The finish hot rolling start temperature at this time was 951° C. For comparison, (B) the slab having the same component was held at 1,030° C. for 60 minutes, was rough hot rolled, in five passes, to a thickness of 75 mm (cumulative reduction ratio: 70%) and was finish hot rolled, in six passes, to obtain a hot rolled sheet having a thickness of 2.3 mm. The finish hot rolling start temperature at this time was 1,020° C. Furthermore, for comparison, (C) the slab having the same components was held at 1,050° C. for 60 minutes, was rough hot rolled, in seven passes, to a thickness of 30 mm (cumulative reduction ratio: 88%), was cooled by water for 40 seconds till the start of finish hot rolling and was finish hot rolled, in six passes, so as to obtain a hot rolled sheet having a thickness of 2.3 mm. The finish hot rolling starting temperature at this time was 790° C.

Each of these hot rolled sheets was pickled without the annealing of hot rolled sheet, and was cold rolled at a reduction ratio of about 85% to obtain a cold rolled sheet having a thickness of 0.335 mm. Then, decarbonization annealing (25% $N_2$+75% $H_2$, dew point=62° C.) by holding the steel sheet for 150 seconds under the following four temperature conditions, that is, (1) 810° C., (2) 820° C., (3) 830° C. and (4) 840° C., was effected, and annealing was carried out by holding the steel sheet at 750° C. for 30 seconds. An $NH_3$ gas was mixed into the annealing atmosphere so as to allow the steel sheet to absorb nitrogen. The N quantity after this nitriding treatment was 0.0229 to 0.0241%, and the mean grain size of the primary recrystallization grains of the steel sheet was 21 to 30 μm.

Next, an annealing separating agent consisting of MgO as the principal component was applied to this steel sheet, and final finish annealing was carried out by a known method.

Table 9 shows the experimental condition and the results of the magnetic properties. By the way, the hot rolling conditions (A) and (B) satisfied the condition N—N as AlN≦0.0030% and (N as AlN)/N≧0.55 in the hot rolled sheet, but the hot rolling condition (C) failed to satisfy this AlN condition.

TABLE 9

| No. | hot rolling | $B_8$ range under 4 decarbonization annealing conditions (T) | remarks |
|---|---|---|---|
| 1 | A | 1.91–1.92 | This Invention |
| 2 | B | 1.89–1.91 | " |
| 3 | C | 1.81–1.89 | Comp. Example |

Example 10

When Z (°C.)=950+9,500×{Al (%)−(27/14)×N (%)} was calculated for two kinds of slabs containing 2.98% of Si, 0.032% of C, 0.025% of acid-soluble Al, 0.0075% of N, 0.12% of Mn and 0.007% of S in terms of a weight ratio and further containing (1) Sn<0.005% and (2) Sn: 0.06%, and having a thickness of 150 mm, it was found to be 1,050. It was predicted that the slab heating temperature should be up to 1,050° C. in order to obtain excellent magnetic properties.

Accordingly, (A) the slab was held at 1,000° C. for 60 minutes, was rough hot rolled, in seven passes, to a thickness of 40 mm (cumulative reduction ratio: 73%), was then cooled by air for 20 seconds till the start of finish hot rolling, and was finish hot rolled, in six passes, so as to obtain a hot rolled sheet having a thickness of 2.3 mm. The finish hot rolling starting temperature at this time was 897° C. For comparison, (B) the slab having the same components was held at 1,000° C. for 60 minutes, was rough hot rolled, in seven passes, to a thickness of 65 mm (cumulative reduction ratio: 57%), was cooled in air for 10 seconds till the start of finish hot rolling, and was finish hot rolled, in six passes, so as to obtain a hot rolled sheet having a thickness of 2.3 mm. The finish hot rolling starting temperature at this time was 923° C. Furthermore, for comparison, (C) the slab having the same components was held at 1,000° C. for 60 minutes, was rough hot rolled, in seven passes, to a thickness of 30 mm (cumulative reduction ratio: 80%), was cooled by water for 20 seconds till the start of finish hot rolling, and was finish hot rolled, in six passes, so a to obtain a hot rolled sheet having a thickness of 2.3 mm. The finish hot rolling starting temperature at this time was 780° C.

Each of these hot rolled sheets was pickled without the annealing of hot rolled sheet, and was cold rolled at a reduction ratio of about 88% to obtain a cold rolled sheet having a thickness of 0.285 mm. Thereafter, decarbonization annealing (25% $N_2$+75% $H_2$, dew point=64° C.) for holding the steel sheet for 150 seconds under the four temperature conditions, that is, (1) 810° C., (2) 820° C., (3) 830° C. and (4) 840° C., was effected, and annealing was then carried out by holding the steel sheet at 750° C. for 30 seconds. An $NH_3$ gas was mixed into the annealing atmosphere so as to allow the steel sheet to absorb nitrogen. The N quantity after this nitriding treatment was 0.0232 to 0.0245%, and the mean grain size of the primary recrystallization grains of the steel sheet was 21 to 30 μm.

Next, an annealing separating agent consisting of MgO as the principal component was applied to this steel sheet, and final finish annealing was carried out by a known method.

Table 10 shows the experimental condition and the results of the magnetic properties. By the way, Nos. 1 and 4 in Table 10 satisfied the conditions N—N as AlN≦0.0030% and (N as AlN)/N≧0.55 in the hot rolled sheet, but the other conditions in Table 10 failed to satisfy this AlN condition.

TABLE 10

| No. | com-ponent | hot rolling | $B_8$ range under 4 decarbonization annealing conditions (T) | remarks |
|---|---|---|---|---|
| 1 | 1 | A | 1.91–1.93 | This Invention |
| 2 | 1 | B | 1.85–1.89 | Comp. Example |
| 3 | 1 | C | 1.83–1.90 | " |
| 4 | 2 | A | 1.92–1.93 | This Invention |
| 5 | 2 | B | 1.86–1.89 | Comp. Example |
| 6 | 2 | C | 1.84–1.89 | " |

Example 11

When Z (°C.)=15+2,500×{Al (%)−(27/14)×N (%)} was calculated for a slab containing 3.25% of Si, 0.046% of C, 0.034% of acid-soluble Al, 0.0062% of N, 0.14% of Mn and 0.007% of S in terms of weight percent and having a thickness of 250 mm and a weight of 20 tons, it was found to be 70. It was predicted from the formula (4) that the deviation of the finish hot rolling start temperatures inside the coil should be up to 70° C. in order to obtain excellent magnetic properties. After the slab was held at 1,150° C. for about 90 minutes, it was rough hot rolled, in seven passes, to a thickness of 40 mm (cumulative reduction ratio: 84%), and was finish hot rolled in six passes to obtain a hot rolled sheet having a thickness of 2.3 mm. At this time, (A) a heat-retaining cover was put on the latter half portion in the rolling direction till the start of finish hot rolling and cooling by air was effected for 15 seconds, and (B) cooling by air was effected for 15 seconds till the start of finish hot rolling. In this case, the finish hot rolling starting temperature was (A) 1,054° to 1,090° C. and (B) 1,010° to 1,089° C.

Each of these hot rolled coils was pickled and was cold rolled at a reduction ratio of about 85% to obtain a cold rolled coil having a thickness of 0.335 mm. Decarbonization annealing (25% $N_2$+75% $H_2$, dew point=62° C.) by holding each coil at 845° C. for 150 seconds was carried out, and then annealing was carried out by holding the coil at 770° C. for 30 seconds. An $NH_3$ gas was mixed into the annealing atmosphere so as to allow the steel sheet to absorb nitrogen. The N quantity after this nitriding treatment was 0.0204 to 0.0230%, and the mean grain size of the primary recrystallization grains of the steel sheet was 23 to 30 μm. Next, an annealing separating agent, consisting of MgO as the principal component, was applied to this steel sheet, and final finish annealing was carried out by a known method.

Table 11 shows the experimental condition and the results of the magnetic properties. By the way, the hot rolling condition (A) in Table 11 satisfied the conditions N—N as AlN≦0.0030% and (N as AlN)/N≧0.55 in the hot rolled coil, but the hot rolling condition (B) failed to satisfy this AlN condition.

TABLE 11

| No. | hot rolling | $B_8$ range inside product coil (T) | remarks |
|---|---|---|---|
| 1 | A | 1.90–1.92 | This Invention |
| 2 | B | 1.80–1.90 | Comp. Example |

Example 12

When Z (°C.)=15+2,500×{Al (%)−(27/14)×N (%)} was calculated for a slab containing 3.07% of Si, 0.031% of C, 0.026% of acid-soluble Al, 0.0070% of N, 0.13% of Mn and 0.006% of S in terms of a weight ratio, and having a thickness of 250 mm and a weight of 10 tons, it was found to be 46. It was predicted from the formula (4) that the deviation of the finish hot rolling starting temperatures inside the coil should be up to 46° C. in order to obtain excellent magnetic properties. After this slab was held at 1,180° C. for about 60 minutes, it was rough hot rolled, in seven passes, to a thickness of 30 mm (cumulative reduction ratio: 88%), and then finish hot rolling was carried out, in six passes, so as to obtain a hot rolled sheet having a thickness of 2.3 mm. At this time, hot rolling was carried out in the following two ways, that is, (A) by cooling the former half portion in the rolling direction by water for 15 seconds till the start of finish hot rolling, and (B) by cooling in air for 15 seconds till the start of finish hot rolling. In this case, the finish hot rolling starting temperature was (A) 1,025° to 1,052° C. and (B) 1,030° to 1,091° C.

Each of the hot rolled coils was pickled and was cold rolled at a reduction ratio of about 85% to obtain a cold rolled coil having a thickness of 0.335 mm. Then, decarbonization annealing (25% $N_2$+75% $H_2$, dew point=64° C.) by holding the coil at 840° C. for 150 seconds was effected, and then annealing was carried out by holding the coil at 770° C. for 30 seconds. An $NH_3$ gas was mixed into the annealing atmosphere so as to allow the steel sheet to absorb nitrogen. The N quantity after this nitriding treatment was 0.0221 to 0.0242%, and the mean grain size of the primary recrystallization grains of the steel sheet was 20 to 26 μm. Next, an annealing separating agent, consisting of MgO as the principal component, was applied to this steel sheet, and final finish annealing was carried out by a known method.

Table 12 shows the experimental conditions and the results of the magnetic properties. By the way, the hot rolling condition (A) in Table 12 satisfied the condition N—N as AlN≦0.0030% and (N as AlN)/N≧0.55 in the hot rolled coil, but the hot rolling condition (B) failed to satisfy this AlN condition.

TABLE 12

| No. | hot rolling | $B_8$ range inside product coil (T) | remarks |
|---|---|---|---|
| 1 | A | 1.89–1.91 | This Invention |
| 2 | B | 1.84–1.89 | Comp. Example |

Example 13

When Z (°C.)=15+2,500×{Al (%)−(27/14)×N (%)} was calculated for a slab containing 2.85% of Si, 0.029% of C, 0.024% of acid-soluble Al, 0.0065% of N, 0.14% of Fin and 0.007% of S in terms of a weight ratio and having a thickness of 250 mm and a weight of 20 tons, it was found to be 44. It was predicted from the formula (4) that the deviation of the finish hot rolling starting temperatures inside the coil should be up to 44° C. in order to obtain excellent magnetic properties. This slab was heated in the two ways, that is, (A) by holding it in a temperature gradient for about 60 minutes so that the leading portion in the rolling direction attained 1,100° C. and the trailing portion attained 1,120° C., and (B) by retaining it at 1,100° C. for about 60 minutes. Rough hot rolling was then effected in seven passes to a thickness of 40 mm (cumulative reduction ratio: 84%). Thereafter, the steel sheet was cooled in air for 5 seconds and finish hot rolling was carried out in six passes so as to obtain a hot rolled sheet having a thickness of 2.6 mm. In this case, the finish hot rolling starting temperature was (A) 1,020° to 1,057° C. and (B) 1,001° to 1,056° C.

Each of these hot rolled coils was pickled and was cold rolled at a reduction ratio of about 87% to obtain a cold rolled coil having a thickness of 0.335 mm. Then, decarbonization annealing (25% $N_2$+75% $H_2$, dew point=60° C.) by holding the coil at 840° C. for 150 seconds was effected, and then annealing was carried out by holding it at 770° C. for 30 seconds. An $NH_3$ gas was mixed into the annealing atmosphere so as to allow the steel sheet to absorb nitrogen. The N quantity after this nitriding treatment was 0.0215 to 0.0237%, and the mean grain size of the primary recrystallization grains of the steel sheet was 25 to 30 μm. Next, an annealing separating agent consisting of MgO ,as the principal component, was applied to this steel sheet, and final finish annealing was carried out by a known method.

Table 13 shows the experimental conditions and the results of the magnetic properties. By the way, the hot rolling condition (A) in Table 13 satisfied the conditions N—N as AlN≦0.0030% and (N as AlN)/N≧0.55 in the hot rolled coil, but the hot rolling condition (B) failed to satisfy this AlN condition.

TABLE 13

| No. | hot rolling | $B_8$ range inside product coil (T) | remarks |
|---|---|---|---|
| 1 | A | 1.90–1.91 | This Invention |
| 2 | B | 1.81–1.89 | Comp. Example |

Example 14

When Z (°C.)=15+2,500×{Al (%)−(27/14)×N (%)} was calculated for two kinds of slabs containing 2.82% of Si, 0.029% of C, 0.034% of acid-soluble Al, 0.0065% of N, 0.14% of Mn, 0.006% of S and furthermore (1) Sn<0.005% and (2) Sn: 0.06% in terms of a weight ratio and having a thickness of 150 mm and a weight of 10 tons, it was found to be 69. It was predicted from the formula (4) that the deviation of the finish hot rolling starting temperatures inside the coil should be up to 69° C. in order to obtain excellent magnetic properties.

Accordingly, (A) the slab was held at 1,100° C. for about 60 minutes, was rough hot rolled, in seven passes, in such a manner that the sheet thickness had a gradient of 40 mm from the leading portion in the rolling direction to 50 mm at the trailing portion (cumulative reduction ratio: 73 to 67%), was then cooled in air for 15 seconds till the start of finish hot rolling, and was then finish hot rolled in six passes to obtain a hot rolled sheet having a thickness of 2.3 mm. The finish hot rolling starting temperature at this time was 865 to 899° C. For comparison, (B) the slab having the same components was held at 1,000° C. for 60 minutes, was then rough hot rolled in five passes to a thickness of 65 mm (cumulative reduction ratio: 57%), was cooled by air for 15 seconds till the start of finish hot rolling, and was finish hot rolled in six passes so as to obtain a hot rolled sheet having a thickness of 2.3 mm. The finish hot rolling starting temperature at this time was 875° to 920° C. Furthermore, for comparison, (C) the slab having the same components was held at 1,000° C. for 60 minutes, was then rough hot rolled, in seven passes, to a thickness of 30 mm (cumulative reduction ratio: 80%), was then cooled by water for 25 seconds will the start of finish hot rolling, and was thereafter finish hot rolled, in six passes, so as to obtain a hot rolled sheet having a thickness of 2.3 mm. The finish hot rolling starting temperature at this time was 755° to 799° C.

Each of these hot rolled coils was pickled and was cold rolled at a reduction ratio of about 88% to obtain a cold rolled coil having a thickness of 0.285 mm. Then, decarbonization annealing (25% $N_2$+75% $H_2$, dew point=60° C.) by holding the coil at 845° C. for 150 seconds was effected, and thereafter annealing was carried out by holding the coil at 750° C. for 30 seconds. An $NH_3$ gas was mixed into the annealing atmosphere so as to allow the steel sheet to absorb nitrogen. The N quantity after this nitriding treatment was 0.0225 to 0.0241%, and the mean grain size of the primary recrystallization grains of the steel sheet was 20 to 31 μm. Next, an annealing separating agent consisting of MgO as the principal component was applied to this steel sheet, and final finish annealing was carried out by a known method.

Table 14 shows the experimental conditions and the results of the magnetic properties. By the way, the conditions Nos. 1 and 4 in Table 14 satisfied the conditions N—N as AlN≦0.0030% and (N as AlN)/N≧0.55 in the hot-rolled coil, but the other conditions in Table 14 failed to satisfy this AlN condition.

TABLE 14

| No. | component | hot rolling | $B_8$ range inside product coil (T) | remarks |
|---|---|---|---|---|
| 1 | 1 | A | 1.91–1.92 | This Invention |
| 2 | 1 | B | 1.84–1.87 | Comp. Example |
| 3 | 1 | C | 1.80–1.88 | " |
| 4 | 2 | A | 1.92–1.93 | This Invention |
| 5 | 2 | B | 1.85–1.88 | Comp. Example |
| 6 | 2 | C | 1.82–1.89 | " |

As described above, the present invention controls the precipitation quantity of AlN in the hot rolled sheet and the mean grain size of the primary recrystallization grains, applies the nitriding treatment to the steel sheet at the stage after hot rolling and before the start of secondary recrystallization of final finish annealing, and further conducts the following procedures:

(1) control of the reduction ratio in rough hot rolling and time control between rough hot rolling and finish hot rolling;

(2) control of the finish hot rolling starting temperature in accordance with the quantities of acid-soluble Al and N of the slab;

(3) control of both the slab heating temperature, in accordance with acid-soluble Al, and of N in the slab, with simultaneous control of the finish hot rolling starting temperature;

(4) control of the deviation in the finish hot rolling start temperature inside the coil in accordance with the quantities of acid-soluble Al and N of the slab; and (5) addition of Sn.

In this way, the present invention can stably obtain excellent magnetic properties even when hot rolled sheet annealing is omitted, by slab heating at low temperature. Accordingly, the present invention provides extremely useful industrial effects.

We claim:

1. A production method of a grain oriented electrical steel sheet having excellent magnetic properties, involving the steps of heating a slab containing not greater than 0.075% of C, 2.2 to 4.5% of Si, 0.010 to 0.060% of acid-soluble Al, not greater than 0.0130% of N, not greater than 0.014% of (S+0.405 Se), 0.05 to 0.8% of Mn in terms of weight percent and the balance consisting of Fe and unavoidable impurities, at a temperature less than 1,280° C., hot rolling the slab to provide a hot rolled sheet, subsequently effecting final cold rolling, at a high reduction at a reduction ratio of at least 80%, without annealing the hot rolled sheet, then effecting decarbonization annealing and applying final finish annealing to obtain a grain oriented electrical steel sheet, said method characterized in that total N in weight percent and N as AlN satisfy relationships $$N\text{-}N \text{ as } AlN \leqq 0.0030\%$$

and $$(N \text{ as } AlN)/N \leqq 0.55,$$

the mean grain size of the primary recrystallization grains at the stage from completion of decarbonization annealing to the start of final finish annealing is 18 to 35 μm, and nitriding treatment is carried out after completion of hot rolling until the start of secondary recrystallization of final finish annealing so as to let the steel sheet absorb nitrogen in an amount of at least 0.0010 wt %.

2. A production method for a grain oriented electrical steel sheet according to claim 1, wherein the cumulative reduction ratio for rough hot rolling is at least 60%, and the time interval between rough hot rolling and finish hot rolling is at least one second.

3. A production method for a grain oriented electrical steel sheet according to claim 1, wherein the contents (wt %) of acid-soluble Al and N of the slab and the start temperature FoT (°C.) of finish hot rolling are controlled to within the range of the following formula (1):

$$800 \leqq FoT\ (°C.) \leqq 900+9{,}500\times\{Al\ (\%)-(27/14)\times N\ (\%)\} \quad (1)$$

where Al is acid-soluble Al.

4. A production method of a grain oriented electrical steel sheet according to claim 1, wherein the quantities of acid-soluble Al and N (wt %) of the slab, and the slab heating temperature ST (°C.), are controlled to within the range of the following formula (2), and the finish hot rolling starting temperature (°C.) is set to be 800° to 1,100° C.:

$$ST\ (°C.) \leqq 950+9{,}500\times\{Al\ (\%)-(27/14)\times N\ (\%)\} \quad (2)$$

where Al is acid-soluble Al.

5. A production method of a grain oriented electrical steel sheet according to claim 1, wherein the quantities of acid-soluble Al and N of the slab (wt %) and the upper limit of with the finish hot rolling starting temperature FoT (°C.) are controlled to the range of the following formula (3):

$$FoT\ (°C.) \leqq 900+9{,}500\times\{Al\ (\%)-(27/14)\times N \quad (3)$$

6. A production method for a grain oriented electrical steel sheet according to claim 1, wherein the start temperature FoT (°C.) of finish hot rolling is from 800° to 1,100° C., a rough hot rolled sheet prior to finish hot rolling being a coil of said rough hot rolled sheet, and the quantities of acid-soluble Al and N (wt %) of the slab and a deviation ΔFoT (°C.) of the finish hot rolling starting temperatures inside the rough hot rolled sheet prior to finish hot rolling are controlled to within the range of the following formula (4):

$$\Delta FoT\ (°C.) \leqq 15+2{,}500\times\{Al\ (\%)-(27/14)\times N\ (\%) \quad (4)$$

where Al is acid-soluble Al.

7. A production method for a grain oriented electrical steel sheet according to claim 1, wherein 0.01 to 0.15% of Sn is further contained as a slab component.

* * * * *

UNITED STATES PATENT AND TRADEMARK OFFICE

CERTIFICATE OF CORRECTION

PATENT NO. : 5,472,521

DATED : December 5, 1995

INVENTOR(S) : Yasunari YOSHITOMI, et al.

It is certified that error appears in the above-indentified patent and that said Letters Patent is hereby corrected as shown below:

Column 2, line 65, after "contains" at end of line insert --A1.--.

Column 3, line 1, change "AS" to --A1--.

Column 4, line 36, change "finial" to --final--.

Column 4, line 40, change "is" to --in--.

Column 6, line 17, change "desitable" to --desirable--.

Column 6, line 32, delete "a" before "weight".

Column 7, line 1, change "(-27/" to ---(27/--.

Column 8, line 35, change "acidsoluble" to --acid-soluble--.

Column 12, line 27, delete "of" after "regulates".

Column 12, line 28, delete "of" after "regulates".

Column 14, line 56, delete "&".

Column 16, line 21, change "an" to --and--.

Column 21, line 18, change "shown" to --should--.

UNITED STATES PATENT AND TRADEMARK OFFICE

CERTIFICATE OF CORRECTION

PATENT NO. : 5,472,521

DATED : December 5, 1995

INVENTOR(S) : Yasunari YOSHITOMI, et al.

It is certified that error appears in the above-indentified patent and that said Letters Patent is hereby corrected as shown below:

Column 24, line 52, change "Fin" to --Mn--.

Column 25, line 65, change "will to --till--.

Column 28, line 13, delete "with" at beginning of line.

Column 28, line 14, after "to" insert --within--.

Column 28, line 16, after "..xN" at end of line insert --(%)--.

Signed and Sealed this

Eleventh Day of June, 1996

Bruce Lehman

*Attest:*

BRUCE LEHMAN

*Attesting Officer*

*Commissioner of Patents and Trademarks*